US005160925A

United States Patent [19]

Dailey et al.

[11] Patent Number: 5,160,925

[45] Date of Patent: Nov. 3, 1992

[54] SHORT HOP COMMUNICATION LINK FOR DOWNHOLE MWD SYSTEM

[75] Inventors: Patrick E. Dailey, Lomita, Calif.; Charles D. Barron, Kingwood, Tex.; Louis H. Rorden, Los Altos, Calif.

[73] Assignees: Smith International, Inc., Houston, Tex.; Develco, Inc., San Jose, Calif.

[21] Appl. No.: 686,772

[22] Filed: Apr. 17, 1991

[51] Int. Cl.[5] ..... G01V 1/00

[52] U.S. Cl. ..... 340/853.3; 340/854.6; 340/853.1; 367/76; 367/81; 367/83; 175/40; 73/151

[58] Field of Search ..... 340/854, 856, 853, 855, 340/853.3, 854.6, 853.1, 854.8; 367/76, 77, 81, 82, 83, 84, 85; 175/40; 73/151

[56] References Cited

U.S. PATENT DOCUMENTS

| | | | |
|---|---|---|---|
| 1,892,217 | 12/1932 | Moineau | 418/48 |
| 2,354,887 | 8/1944 | Silverman et al. | 340/854.6 |
| 2,411,696 | 11/1946 | Silverman et al. | 340/854.6 |
| 2,414,719 | 1/1947 | Cloud | 340/854.6 |
| 3,079,549 | 2/1963 | Martin | 340/854.6 |
| 3,090,031 | 5/1963 | Lord | 340/854.6 |
| 3,094,658 | 6/1963 | Bravenec et al. | 324/6 |
| 3,214,686 | 10/1965 | Elliot et al. | 324/6 |
| 3,305,771 | 2/1967 | Arps | 324/6 |
| 3,582,766 | 6/1971 | Iiuzuka | 324/6 |
| 3,790,930 | 2/1974 | Lamel et al. | 175/40 |
| 3,793,632 | 2/1974 | Still | 340/853.7 |
| 3,849,721 | 11/1974 | Calvert | 324/6 |
| 3,879,097 | 4/1975 | Oertle | 340/854.4 |
| 3,906,434 | 9/1975 | Lamel et al. | 175/40 |
| 3,918,537 | 11/1975 | Heilhecker | 175/320 |
| 3,932,836 | 1/1976 | Harrell et al. | 175/40 |
| 3,949,354 | 4/1976 | Claycomb | 367/83 |
| 3,958,217 | 5/1976 | Spinnler | 367/83 |
| 3,964,556 | 6/1976 | Gearhart et al. | 367/83 |

(List continued on next page.)

FOREIGN PATENT DOCUMENTS 2146126 4/1985 United Kingdom .

OTHER PUBLICATIONS

Giannesini, Jean-Francois, "Horizontal Drilling Becoming Commonplace," *World Oil*, Mar. 1989, pp. 35-38, 40.

Littleton, Jeff, "Self-Correcting Steerable System," *Offshore*, Nov. 1988, p.17.

The Houston Chronicle, May 7, 1990, p. 3B.

*Primary Examiner*—J. Woodrow Eldred

*Attorney, Agent, or Firm*—William E. Shull; Michael F. Heim; C. Michael Zimmerman

[57] ABSTRACT

The short hop communication link includes a sensor module positioned downhole from a motor in a well. The module includes sensors that monitor operational, directional and environmental parameters downhole and provide an electrical data signal indicative thereof. Sensors may also be positioned in the drill bit for obtaining parameters related to the bit, and communicating data signals reflecting the sensed parameters to the sensor module. The sensor module includes a transceiver, with an annular antenna, for transmitting electromagnetic sensor data signals to a point above the motor. A control module, which also includes a transceiver with an annular antenna, is located above the motor, and receives the electromagnetic signals from the sensor module reflecting the sensed parameters. In addition, the control module is capable of transmitting command signals to the sensor module requesting data regarding desired parameters. The command module connects to a host module which orchestrates all measurement-while-drilling components downhole. The host module connects to a mud pulser for transmitting desired data to the surface for real-time processing. The sensor module is strategically placed within a removable, interchangeable sub below the motor, or alternatively, within an extended driveshaft of the motor, while the sensor antenna is located on an exterior shoulder of the sub or driveshaft. The sensor module and an associated battery pack reside within a pressure container which forms part of a current return path from the sensor antenna to the circuitry within the sensor module.

80 Claims, 16 Drawing Sheets

U.S. PATENT DOCUMENTS

| | | | |
|---|---|---|---|
| 3,967,201 | 6/1976 | Rorden | 340/854.6 |
| 3,982,797 | 9/1976 | Tschirky et al. | 308/139 |
| 3,982,858 | 9/1976 | Tschirky | 418/48 |
| 4,029,368 | 6/1977 | Tschirky et al. | 308/8.2 |
| 4,051,910 | 10/1977 | Clark | 175/103 |
| 4,057,781 | 11/1977 | Scherbatskoy | 340/854.6 |
| 4,067,404 | 1/1978 | Crase | 175/75 |
| 4,077,657 | 3/1978 | Trzeciak | 285/184 |
| 4,087,781 | 5/1978 | Grossi et al. | 340/854.6 |
| 4,098,561 | 7/1978 | Tschirky et al. | 175/371 |
| 4,126,848 | 11/1978 | Denison | 166/206 |
| 4,181,014 | 1/1980 | Zuvela et al. | 340/856 |
| 4,181,184 | 1/1980 | Scherbatskoy | 175/65 |
| 4,185,238 | 1/1980 | Huchital et al. | 324/338 |
| 4,198,104 | 4/1980 | Crase | 308/139 |
| 4,199,201 | 4/1980 | Trzeciak | 308/8.2 |
| 4,209,747 | 6/1980 | Huhital | 324/338 |
| 4,215,426 | 7/1980 | Klatt | 367/83 |
| 4,216,536 | 8/1980 | More | 367/83 |
| 4,220,380 | 9/1980 | Crase et al. | 308/174 |
| 4,229,296 | 11/1980 | Gezcy | 175/65 |
| 4,240,683 | 12/1980 | Crase | 308/227 |
| 4,260,202 | 4/1981 | Crase et al. | 308/8.2 |
| 4,278,941 | 7/1981 | Freedman | 324/341 |
| 4,300,098 | 11/1981 | Huchital et al. | 324/338 |
| 4,302,757 | 11/1981 | Still | 340/854.6 |
| 4,324,297 | 4/1982 | Denison | 73/151 |
| 4,329,127 | 5/1982 | Tschirky et al. | 418/48 |
| 4,346,591 | 8/1982 | Evans | 73/151 |
| 4,348,672 | 9/1982 | Givler | 340/854.6 |
| 4,351,037 | 9/1982 | Scherbatskoy | 367/85 |
| 4,387,372 | 6/1983 | Smith et al. | 340/854.6 |
| 4,401,134 | 8/1983 | Dailey | 251/29 |
| 4,415,895 | 11/1983 | Flagg | 181/103 |
| 4,416,000 | 11/1983 | Scherbatskoy | 367/81 |
| 4,445,578 | 5/1984 | Millheim | 175/45 |
| 4,451,789 | 5/1984 | Meador | 324/338 |
| 4,468,665 | 8/1984 | Thawley et al. | 340/854.6 |
| 4,511,193 | 4/1985 | Geczy | 384/611 |
| 4,515,225 | 5/1985 | Dailey | 175/40 |
| 4,520,468 | 5/1985 | Scherbatskoy | 367/83 |
| 4,536,714 | 8/1985 | Clark | 324/338 |
| 4,538,109 | 8/1985 | Clark | 324/338 |
| 4,553,097 | 11/1985 | Clark | 324/338 |
| 4,553,226 | 11/1985 | Scherbatskoy | 367/83 |
| 4,560,014 | 12/1985 | Geczy | 175/107 |
| 4,578,675 | 3/1986 | MacLeod | 340/854.6 |
| 4,597,067 | 6/1986 | Bockhorst et al. | 367/82 |
| 4,617,960 | 10/1986 | More | 166/250 |
| 4,622,518 | 11/1986 | Cox et al. | 324/341 |
| 4,626,785 | 12/1986 | Hagiwara | 324/339 |
| 4,630,243 | 12/1986 | MacLeod | 367/82 |
| 4,637,479 | 1/1987 | Leising | 175/26 |
| 4,646,083 | 2/1987 | Woods | 340/854.6 |
| 4,651,101 | 3/1987 | Barber et al. | 324/339 |
| 4,656,944 | 4/1987 | Gonzalez | 102/312 |
| 4,662,458 | 5/1987 | Ho | 175/27 |
| 4,667,751 | 5/1987 | Geczy et al. | 175/61 |
| 4,676,310 | 6/1987 | Scherbatskoy | 166/65.1 |
| 4,684,946 | 8/1987 | Issenmann | 175/50 |
| 4,689,775 | 8/1987 | Scherbatskoy | 367/83 |
| 4,691,203 | 9/1987 | Rubin et al. | 340/854.6 |
| 4,692,706 | 9/1987 | Mazzagatti et al. | 324/338 |
| 4,692,911 | 9/1987 | Scherbarskoy | 367/83 |
| 4,710,708 | 12/1987 | Rorden et al. | 324/207 |
| 4,725,837 | 2/1988 | Rubin | 340/854.6 |
| 4,730,161 | 3/1988 | Cox et al. | 324/338 |
| 4,736,791 | 4/1988 | Rorden et al. | 166/319 |
| 4,739,325 | 4/1988 | MacLeod | 340/854.6 |
| 4,766,442 | 8/1988 | Issenmann | 343/719 |
| 4,780,679 | 10/1988 | Kenyon et al. | 324/338 |
| 4,785,247 | 11/1988 | Meador et al. | 324/338 |
| 4,787,093 | 11/1988 | Rorden | 375/23 |
| 4,788,544 | 11/1988 | Howard | 340/854.6 |
| 4,796,708 | 1/1989 | Lembcke | 166/386 |
| 4,800,385 | 1/1989 | Yamazaki | 340/854.6 |
| 4,806,928 | 2/1989 | Veneruso | 175/40 |
| 4,808,929 | 2/1989 | Oldigs | 324/339 |
| 4,814,609 | 3/1989 | Wraight et al. | 250/254 |
| 4,829,310 | 5/1989 | Losee | 343/719 |
| 4,839,644 | 6/1989 | Safinya et al. | 340/854.6 |
| 4,839,661 | 6/1989 | Losee | 343/719 |
| 4,839,870 | 6/1989 | Scherbatskoy | 367/83 |
| 4,845,433 | 7/1989 | Kleinberg et al. | 324/338 |
| 4,854,397 | 8/1989 | Warren et al. | 175/26 |
| 4,857,852 | 8/1989 | Kleinberg et al. | 324/339 |
| 4,864,293 | 9/1989 | Chau | 340/853 |
| 4,866,680 | 9/1989 | Scherbatskoy | 367/83 |
| 4,873,488 | 10/1989 | Barber et al. | 324/339 |
| 4,876,511 | 10/1989 | Clark | 324/338 |
| 4,899,112 | 2/1990 | Clark et al. | 324/338 |
| 4,901,069 | 2/1990 | Veneruso | 340/853 |
| 4,903,245 | 2/1990 | Close et al. | 367/81 |
| 4,908,804 | 3/1990 | Rorden | 367/81 |
| 4,932,005 | 6/1990 | Birdwell | 367/83 |

SHORT HOP COMMUNICATION LINK FOR DOWNHOLE MWD SYSTEM

BACKGROUND OF THE INVENTION

The present invention relates generally to a downhole telemetry system for facilitating the measurement of borehole and drilling data, storing the data in memory, and transmitting the data to the surface for inspection and analysis. More particularly, the invention relates to a measurement-while-drilling ("MWD") system that senses and transmits data measurements from the bottom of a downhole assembly a short distance around components in the drill string. Still more particularly, the present invention relates to an MWD system capable of measuring environmental conditions and operating parameters relating to the drill bit and/or motor and transmitting the data measurements real-time around the motor.

The advantages of obtaining downhole data measurements from the motor and drill bit during drilling operations are readily apparent to one skilled in the art. The ability to obtain data measurements while drilling, particularly those relating to the operation of the drill bit and motor and the environmental conditions in the region of the drill bit, permit more economical and more efficient drilling. Some of the primary advantages are that the use of real time transmission of bit temperatures permits real time adjustments in drilling parameters for optimizing bit performance, as well as maximizing bit life. Similar measurements of drilling shock and vibration allow for adjusting or "tuning" parameters to drill along the most desirable path, or at the "sweet spot," thereby optimizing and extending the life of the drilling components. Measurement of the inclination angle in the vicinity of the drill bit enhances drilling control during directional drilling.

One advantage of positioning sensors closer to the bit is made clear in the following example, shown in FIG. 1. FIG. 1 depicts a downhole formation, with an oil-producing zone that has a depth of approximately twenty-five feet. A conventional steerable drilling assembly is shown in FIG. 1, which includes a drill bit, a motor, and a sensor sub located between 25–50 feet above the drill bit. As shown in FIG. 1, the drill bit and motor have passed substantially through the oil-producing zone before the sensors are close enough to detect the zone. As a result, time is wasted in re-positioning and re-directing the downhole assembly. This is particularly costly in a situation where the intended well plan is to use the steerable system in FIG. 1 to drill horizontally in the zone.

If the sensors were located in or closer to the bit, the sensors would have detected the zone sooner, and the direction of the drilling assembly in FIG. 1 could have been altered sooner to drill in a more horizontal direction to stay in the oil-producing zone.

This, of course, is but one example of the advantages of placing the sensors in or very near to the bit. Other advantages of recovering data relating to the drill bit and motor will be apparent to those skilled in the art.

There are a number of systems in the prior art which seek to transmit information regarding parameters downhole up to the surface. None of these prior art telemetry systems, however, senses and transmits data regarding operational, environmental, and directional parameters from below a motor to a position above the motor. These prior systems may be descriptively characterized as: (1) mud pressure pulse; (2) hard-wire connection; (3) acoustic wave; and (4) electromagnetic waves.

In a mud pressure pulse system, the drilling mud pressure in the drill string is modulated by means of a valve and control mechanism mounted in a special pulser collar above the drill bit and motor (if one is used). The pressure pulse travels up the mud column at or near the velocity of sound in the mud, which is approximately 4000–5000 feet per second. The rate of transmission of data, however, is relatively slow due to pulse spreading, modulation rate limitations, and other disruptive forces, such as the ambient noise in the drill string. A typical pulse rate is on the order of a pulse per second. A representative example of mud pulse telemetry systems may be found in U.S. Pat. Nos. 3,949,354, 3,964,556, 3,958,217, 4,216,536, 4,401,134, 4,515,225, 4,787,093 and 4,908,804.

Hard-wire connectors have also been proposed to provide a hard wire connection from the bit to the surface. There are a number of obvious advantages to using wire or cable systems, such as the ability to transmit at a high data rate; the ability to send power downhole; and the capability of two-way communication. Examples of hard wire systems may be found in U.S. Pat. Nos. 3,879,097, 3,918,537 and 4,215,426.

The transmission of acoustic or seismic signals through a drill pipe or the earth (as opposed to the drilling mud) offers another possibility for communication. In such a system, an acoustic or seismic generator is located downhole near or in the drill collar. A large amount of power is required downhole to generate a signal with sufficient intensity to be detected at the surface. The only way to provide sufficient power downhole (other than running a hard wire connection downhole) is to provide a large power supply downhole. An example of an acoustic telemetering system is Cameron Iron Works' CAMSMART downhole measurement system, as published in the Houston Chronicle on May 7, 1990, page 3B.

The last major prior art technique involves the transmission of electromagnetic ("EM") waves through a drill pipe and the earth. In this type of system, downhole data is input to an antenna positioned downhole in a drill collar. Typically, a large pickup assembly or loop antenna is located around the drilling rig, at the surface, to receive the EM signal transmitted by the downhole antenna.

The major problem with the prior art EM systems is that a large amount of power is necessary to transmit a signal that can be detected at the surface. Propagation of EM waves is characterized by an increase in attenuation with an increase in distance, data rate and earth conductivity. The distance between the downhole antenna and the surface antenna may be in the range of 5,000 to 10,000 feet. As a result, a large amount of attenuation occurs in the EM signal, thereby necessitating a more powerful EM wave. The conductivity of the earth and the drilling mud also may vary significantly along the length of the drill string, causing distortion and/or attenuation of the EM signal. In addition, the large amount of noise in the drilling string causes interference with the EM wave.

The primary way to supply the requisite amount of power necessary to transmit the EM wave to the surface is to provide a large power supply downhole or to run a hard wire conductor downhole. Representative examples of EM systems can be found in U.S. Pat. Nos. 2,354,887, 3,967,201, 4,215,426, 4,302,757, 4,348,672, 4,387,372, 4,684,946, 4,691,203, 4,710,708, 4,725,837, 4,739,325, 4,766,442, 4,800,385, and 4,839,644.

There have been attempts made in the prior art to reduce the effects of attenuation which occur during the transmission of an EM signal from down near the downhole drilling assembly to the surface. U.S. Pat. No. 4,087,781, issued to Grossi, et al., for example, discloses the use of repeater stations to relay low frequency signals to and from sensors near the drilling assembly. Similarly, U.S. Pat. No. 3,793,632 uses repeater stations to increase data rate and, in addition, suggests using two different modes of communication to prevent interference. U.S. Pat. Nos. 2,411,696 and 3,079,549 also suggest using repeater stations to convey information from downhole to the surface. None of these systems has been successful, based primarily on the varying conditions encountered downhole, where conductivity may range over several orders of magnitude.

Moreover, none of the prior art systems has addressed the additional problems which arise when the telemetry system is located below a motor or turbine. A motor causes additional problems because, by definition, one end of the motor has a relative motion with respect to the other end. This motion hinders the transmission of signals by any of the known techniques. Moreover, the fact that the motor has a relative motion at one end with respect to the other also means that a large amount of noise is generated in the region of the motor, thereby making it more difficult to communicate signals in the vicinity of the motor.

Nor do the prior art references address the problems inherent in positioning the sensors in or very close to the drill bit, or recovering data from these sensors. The prior art systems place the sensors a distance above the drill bit to determine conditions above the drill bit.

Furthermore, space below the motor is extremely limited, so that there is not sufficient space for a power source to generate signals with the necessary intensity to reach the surface. This is especially true in a steerable system which has a bent housing, as shown in FIG. 2B. If the length of the assembly below the bent housing becomes too long, the side forces on the drill bit become excessive for the moment arm between the bent housing and the drill bit. Furthermore, when the motor is operating and the drill string is rotating, i.e., the system is drilling in a straight mode, the length between the drill bit and the bent housing becomes critical. The longer this length, the larger will be the diameter of the hole that will be drilled.

Thus, while it would be advantageous to obtain information regarding the operating parameters and environmental conditions of the drill bit and motor, to date no one has successfully developed a telemetry system capable of obtaining this data and transmitting it back to the surface.

SUMMARY OF THE INVENTION

Accordingly, the present invention includes a data acquisition system for transmission of measured operating, environmental and directional parameters a short distance around a motor or other bottom-hole assembly component. Sensors are placed in a module between the motor or such other component and the drill bit for monitoring the operation and direction of the motor or other component and drill bit, as well as environmental conditions in the vicinity of the drill bit. Sensors also may be positioned in the drill bit and electrically connected to circuitry in the sensor module. The sensor module includes a transmitter for transmitting an electromagnetic signal indicative of the measured data recovered from the various sensors. The sensor module may also include a processor for conditioning the data and for storing the data values in memory for subsequent recovery. In addition, the sensor module may include a receiver for receiving commands from a control module uphole.

The sensor module may be positioned either in the driveshaft of the motor or in a detachable sub (preferred embodiment) positioned between the motor and the drill bit. In either of these positions, the sensors in the sensor module are in close proximity to both the drill bit and motor, and thus are able to obtain data regarding desired bit and/or motor parameters. The sensor module also connects electrically to the sensors in the drill bit, to receive electrical signals from the bit representative of environmental and operational bit parameters. The sensor module processes these signals and transmits the processed information to the control module.

The control module is positioned a relatively short distance away in a control transceiver sub, either above or below the mud pulser collar. The control module includes a transceiver for transmitting command signals and for receiving signals indicative of sensed parameters to and from the sensor module. The control transceiver receives the electromagnetic signals from the sensor transmitter and relays the data signals to processing circuitry in the control module, which formats and/or stores the data. The control module transmits electrical signals to a host module, which connects to all measurement-while-drilling ("MWD") components downhole to control the operation of all the downhole sensors. Each of the downhole sensors includes its own microprocessor to receive commands from the host module and to transmit signals indicative of sensed data.

The host module includes a battery to power all of the sensor microprocessors and related circuitry. Thus, the host module also powers the EM control module circuitry. The host module connects to a mud pulser, which, in turn, transmits mud pulses, reflecting some or all of the sensed data, to a receiver on the surface.

Both the sensor module and the control module include an antenna arrangement through which the EM signals are sent and received. The antennas are comprised of strips of laminated iron/nickel alloy wound into an annular transformer core, with insulation placed between each laminated strip. The sensor or downhole antenna is strategically mounted on the exterior of a sub or extended driveshaft, and the control or uphole antenna is mounted on the exterior of the control sub.

The present invention may be used with a wide variety of motors, including mud motors, with or without a bent housing, mud turbines and other devices that have motion at one end relative to the other. The present invention may also be used in circumstances where no motor is used, to convey data from the drill bit a short distance in a downhole assembly, such as, for example, around a mud pulser. The system can also use telemetry systems other than a mud pulser to relay the measured data to the surface.

Because the EM signal need only travel a relatively short distance, a relatively small power supply can be used, such as a battery. The battery, located downhole near the sensor module, provides power to the transmitter, the sensors and the processor. Like the sensor module, the battery can be located either in the driveshaft of the motor or in a separate, removable sub (as described in the preferred embodiment).

Because the conductivity may vary over several orders of magnitude, the present invention is capable of operating over a wide range of frequencies. The system operates by determining the frequency that functions best for a given formation and emits signals at that frequency to maximize the signal-to-noise ratio.

These and various other characteristics and advantages of the present invention will become readily apparent to those skilled in the art upon reading the following detailed description.

BRIEF DESCRIPTION OF THE DRAWINGS

For a detailed description of the preferred embodiment of the invention, reference will be made now to the accompanying drawings, wherein.

During the course of the following description, the terms "uphole," "upper," "above" and the like are used synonymously to reflect position in a well path, where the surface of the well is the upper or topmost point. Similarly, the terms "bottom-hole," "downhole," "lower," "below" and the like are also used to refer to position in a well path where the bottom of the well is the furthest point drilled along the well path from the surface, and the term "subsurface" indicates a downhole location remote from the surface of the well. As one skilled in the art will realize, a well may vary significantly from the vertical, and, in fact, may at times be horizontal. Thus, the foregoing terms should not be regarded as relating to depth or verticality, but instead should be construed as relating to the position in the path of the well between the surface and the bottom of the well.

DETAILED DESCRIPTION OF THE PREFERRED EMBODIMENT

I. DOWNHOLE DRILLING SYSTEM

Figure 1:
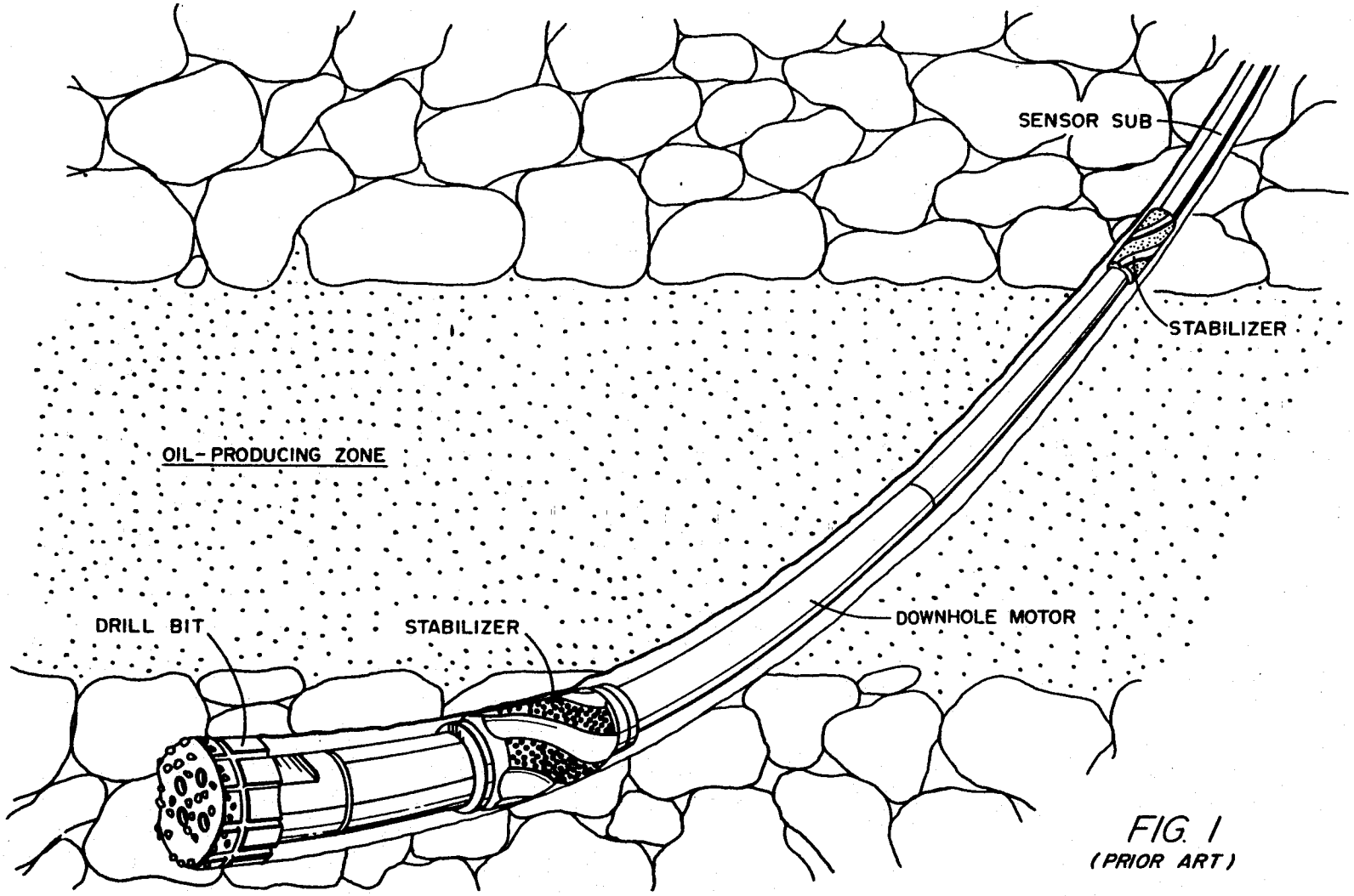
FIG. 1 (PRIOR ART)
FIG. 1 is a perspective view of a prior art directional drilling assembly drilling through an earth formation.
Figure 2A:
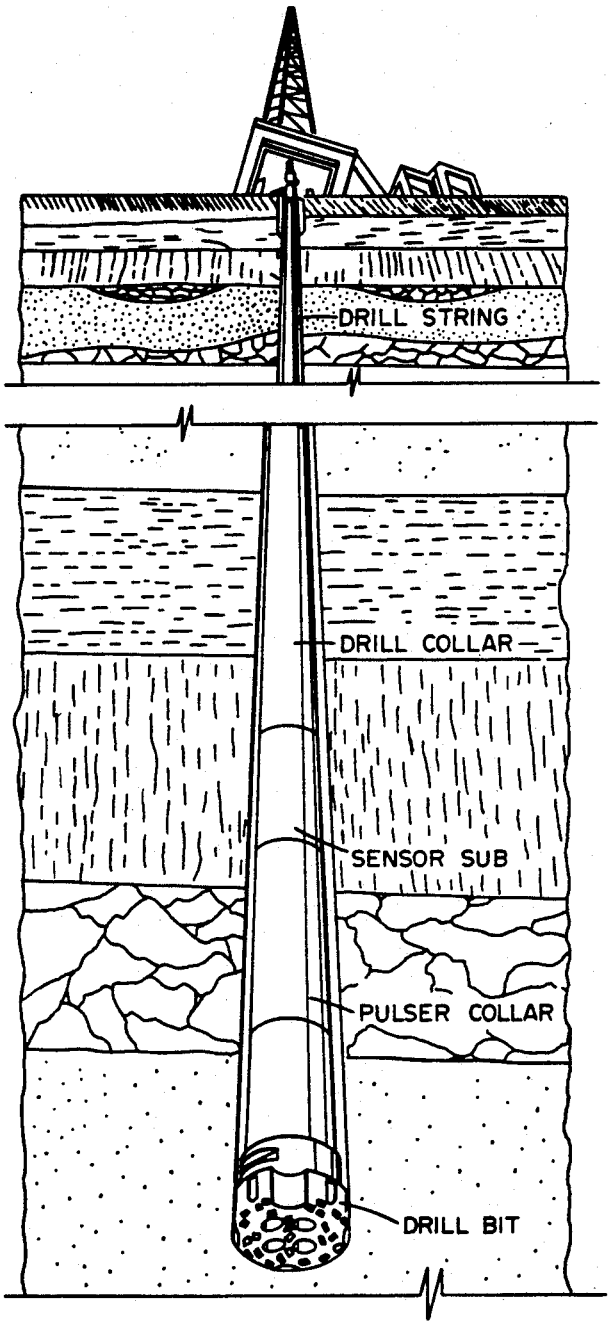
FIG. 2A (PRIOR ART)
FIG. 2A is a perspective view of a prior art rotary drilling system.
Figure 2B:
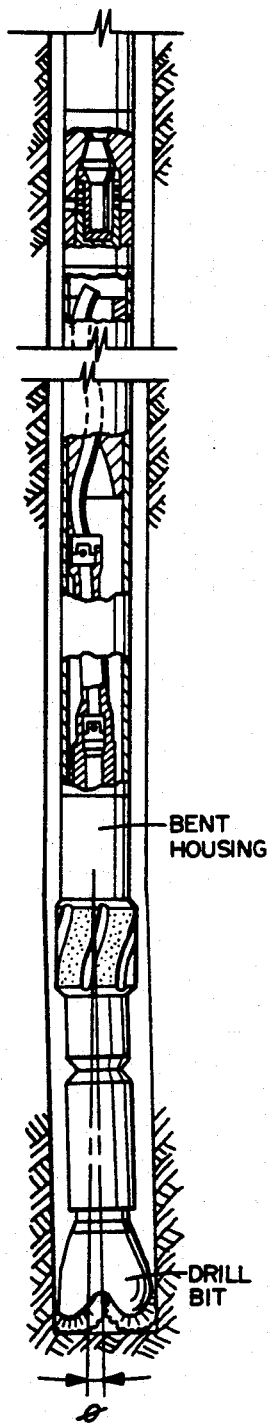
FIG. 2B (PRIOR ART)
FIG. 2B is a partially sectional front elevation of a prior art steerable drilling system.

Two prior art drilling systems are shown in FIGS. 2A and 2B. FIG. 2A illustrates a prior art drilling system that operates solely in a rotary mode, while FIG. 2B depicts a prior art steerable system that permits both straight and directional drilling. The rotary drilling system shown in FIG. 2A includes a drill bit with a pulser collar for relaying data to the surface via mud pulses. Above the pulser collar is a sensor sub which includes a variety of sensors for measuring parameters in the vicinity of the drill collar, such as resistivity, gamma, weight-on-bit, and torque-on-bit. The sensors transmit data to the pulser, which in turn, transmits a mud pressure pulse to the surface. An example of a mud pulse telemetry system may be found in U.S. Pat. Nos. 4,401,134 and 4,515,225, the teachings of which are incorporated by reference as if fully set forth herein.

A non-magnetic drill collar typically is located above the sensor modules. Typically, the drill collar includes a directional sensor probe. The drill collar connects to the drill string, which extends to the surface.

Drilling occurs in a rotary mode by rotation of the drill string at the surface, causing the bit to rotate downhole. Drilling mud is forced through the interior of the drill string to lubricate the bit and to remove cuttings at the bottom of the well. The drilling mud then circulates back to the surface by flowing on the outside of the drill string. The mud pulser receives data indicative of conditions near, but not at, the bottom of the well, and modulates the pressure of the drilling mud either inside or outside the drill string. The fluctuations in the mud pressure are detected at the surface by a receiver.

The prior art steerable system shown in FIG. 2B has the added ability to drill in either a straight mode or in a directional or "sliding" mode. See U.S. Pat. No. 4,667,751, the teachings of which are incorporated by reference as if fully set forth herein. The steerable system includes a motor which functions to operate the bit. In a prior art motor, such as that disclosed in U.S. Pat. No. 4,667,751, the motor includes a motor housing, a bent housing, and a bearing housing. The motor housing preferably includes a stator constructed of an elastomer bonded to the interior surface of the housing and a rotor mating with the stator. The stator has a plurality of spiral cavities, n, defining a plurality of spiral grooves throughout the length of the motor housing. The rotor has a helicoid configuration, with n-1 spirals helically wound about its axis. See U.S. Pat. Nos. 1,892,217, 3,982,858, and 4,051,910.

During drilling operations, drilling fluid is forced through the motor housing into the stator. As the fluid passes through the stator, the rotor is forced to rotate and to move from side to side within the stator, thus creating an eccentric rotation at the lower end of the rotor.

The bent housing includes an output shaft or connecting rod, which connects to the rotor by a universal joint or knuckle joint. According to conventional techniques, the bent housing facilitates directional drilling. See U.S. Pat. Nos. 4,299,296 and 4,667,751. To operate in a directional mode, the bit is positioned to point in a specific direction by orienting the bend in the bent housing in a specific direction. The motor then is activated by forcing drilling mud therethrough, causing operation of the drill bit. As long as the drill string remains stationary (it does not rotate), the drill bit will drill in the desired direction according to the arc of curvature established by the degree of bend in the bent housing, the orientation of the bend and other factors such as weight-on-bit. In some instances, the degree of bend in the bent housing may be adjustable to permit varying degrees of curvature. See U.S. Pat. Nos. 4,067,404 and 4,077,657. Typically, a concentric stabilizer also is provided to aid in guiding the drill bit. See U.S. Pat. No. 4,667,751.

To operate in a straight mode, the drill string is rotated at the same time the motor is activated, thereby causing a wellbore to be drilled with an enlarged diameter. See U.S. Pat. No. 4,667,751. The diameter of the wellbore is directly dependent on the degree of bend in the bent housing and the location of the bend. The smaller the degree of bend and the closer the placement of the bend is to the drill bit, the smaller will be the diameter of the drilled wellbore.

The bearing housing contains the driveshaft, which connects to the output shaft by a second universal or knuckle joint. The eccentric rotation of the rotor is translated to the driveshaft by the universal joints and the output shaft, causing the driveshaft to rotate. Because of the tremendous amount of force placed on the motor downhole, radial and thrust bearings are provided in the bearing housing. One of the functions of the bearings is to maintain the driveshaft concentrically within the bearing housing. Representative examples of radial and thrust bearings may be found in U.S. Pat. Nos. 3,982,797, 4,029,368, 4,098,561, 4,198,104, 4,199,201, 4,220,380, 4,240,683, 4,260,202, 4,329,127, 4,511,193, and 4,560,014. The necessity of having bearings in the driveshaft housing contributes greatly to the difficulty in developing a telemetry system that transmits data through or around a motor.

II. SHORT HOP DATA ACQUISITION SYSTEM

Figure 3:
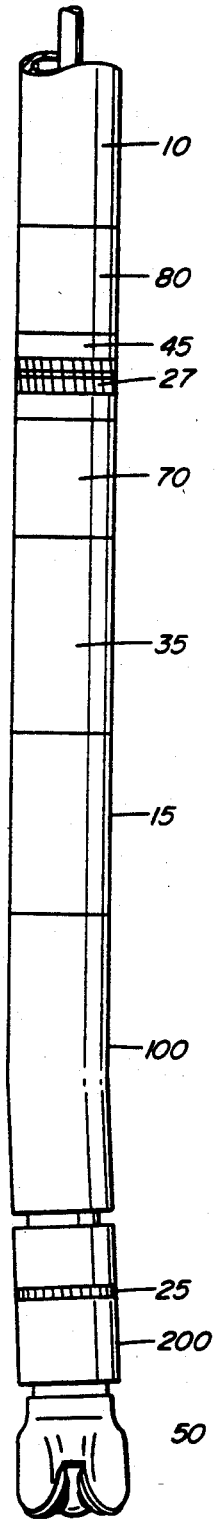
FIG. 3 is a schematic diagram of the preferred embodiment of the short hop data telemetry system of the present invention, which utilizes an extended sub between the motor and drill bit.
Figure 5:
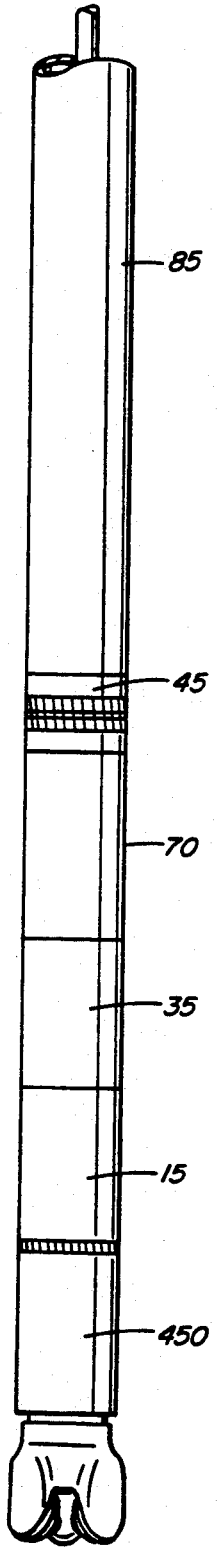
FIG. 5 is a schematic diagram of an alternative embodiment of the short hop data telemetry system of the present invention, configured for use without a downhole motor.
Figure 6:
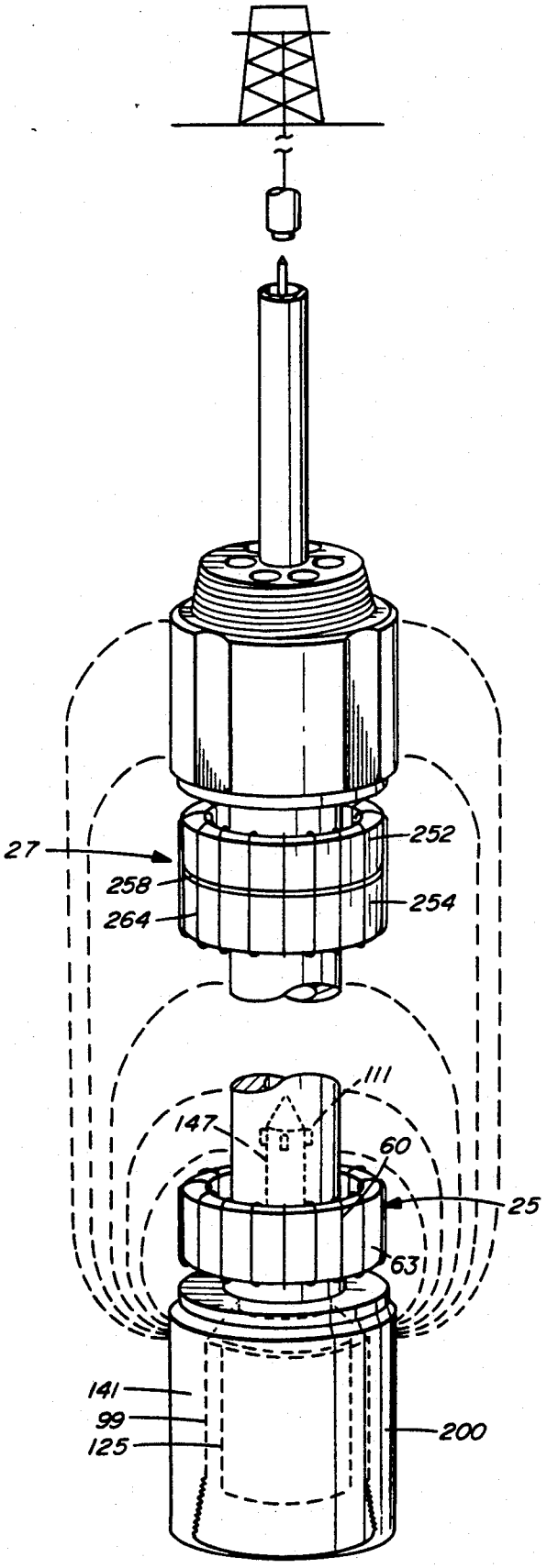
FIG. 6 is a partly schematic, partly isometric fragmentary view of the short hop system shown in FIG. 3.

Referring now to FIGS. 3 and 6, the short hop data acquisition system configured in accordance with the preferred embodiment comprises a bottom-hole assembly having a drill bit 50, a motor 100 with an extended sub 200 connected to the drill bit 50, a sensor antenna 25 located on the exterior of the sub 200, a sensor module 125 positioned inside the extended sub 200, a pulser collar 35 positioned uphole from the motor 100, a control module 40 (FIG. 10A) located in a sub 45 near the pulser collar 35, a host module 10, a control antenna 27 mounted on the exterior of control sub 45, and a guard sub 70. A drill collar (85 in FIG. 5, not shown in FIGS. 3 and 4) and the drill string (not shown) connect the downhole assembly to the drilling rig (not shown), according to conventional techniques. Other subs 15 and/or sensor subs 80 may be included as required in the downhole system.

Figure 4:
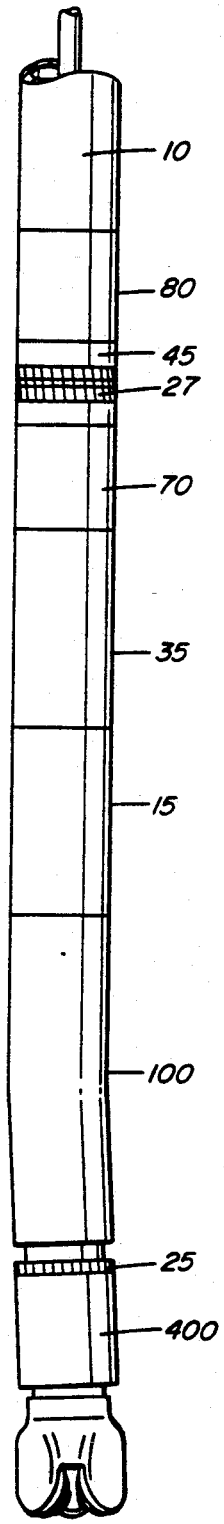
FIG. 4 is a schematic diagram of an alternative embodiment of the short hop data telemetry system of FIG. 3, which utilizes an extended driveshaft in place of the extended sub.

In an alternative embodiment shown in FIG. 4, the sensor module is housed in an extended driveshaft 400 below the motor 100. Bearings (not shown) are provided on the interior surface of the bearing housing of the motor according to conventional techniques to maintain the driveshaft 400 concentrically within the bearing housing. As one skilled in the art will realize, various bearings may be used. The alternative embodiment of FIG. 4 is preferably constructed in the same manner as the preferred embodiment of FIG. 3, except that the sensor module 125 and antenna 25 are housed in the extended driveshaft 400, instead of the sub 200. With this difference in mind, one skilled in the art will realize that the following description regarding the preferred embodiment of FIG. 3 is equally applicable to the alternative embodiment of FIG. 4.

In yet another alternative embodiment, shown in FIG. 5, the present invention can be used without a motor, to transmit signals a short distance downhole around certain components, such as a mud pulser 35. In such a scenario, the sensor module 125 is housed in a sensor sub 450, which preferably is interchangeable with the sensor sub 200 of FIG. 3. As one skilled in the art will realize, the present invention also finds application in areas other than MWD systems to situations where it is desirable to convey information a short distance around a downhole component.

A. Motor and Extended Sub

Referring again to FIG. 3, the motor 100 preferably comprises a Dyna-Drill positive displacement motor with a bent housing, made by Smith International, Inc., as described, supra, in Section I Downhole Drilling System and as shown in U.S. Pat. No. 4,667,751. Other motors, including mud turbines, mud motors, Moineau motors, creepy crawlers and other devices that generate motion at one end relative to the other, may be used without departing from the principles of the present invention.

Referring now to FIGS. 3 and 6, the motor 100, in accordance with the preferred embodiment, connects to an extended sub 200 which houses a sensor module 125 and its associated antenna 25. One particular advantage of this embodiment is that the extended sub 200 may be removed and used interchangeably in a variety of downhole assemblies.

Figure 8:
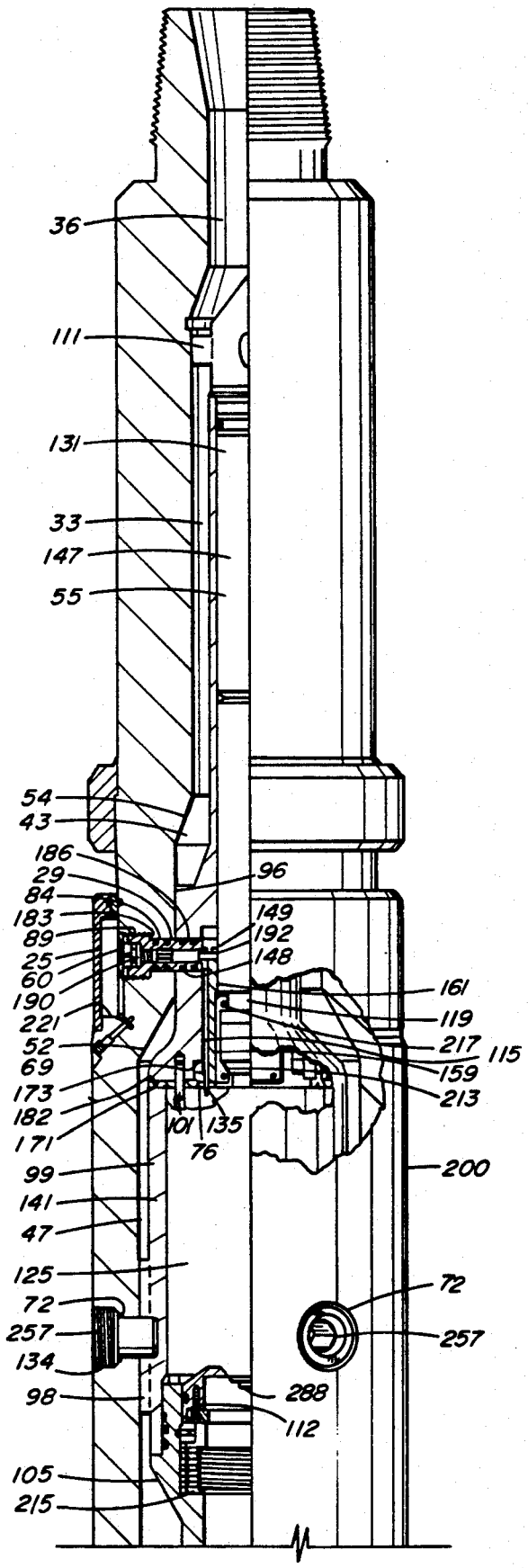
FIG. 8 is a view, partly in vertical section and partly in elevation, of the extended sub shown in FIG. 3.
Figure 9:
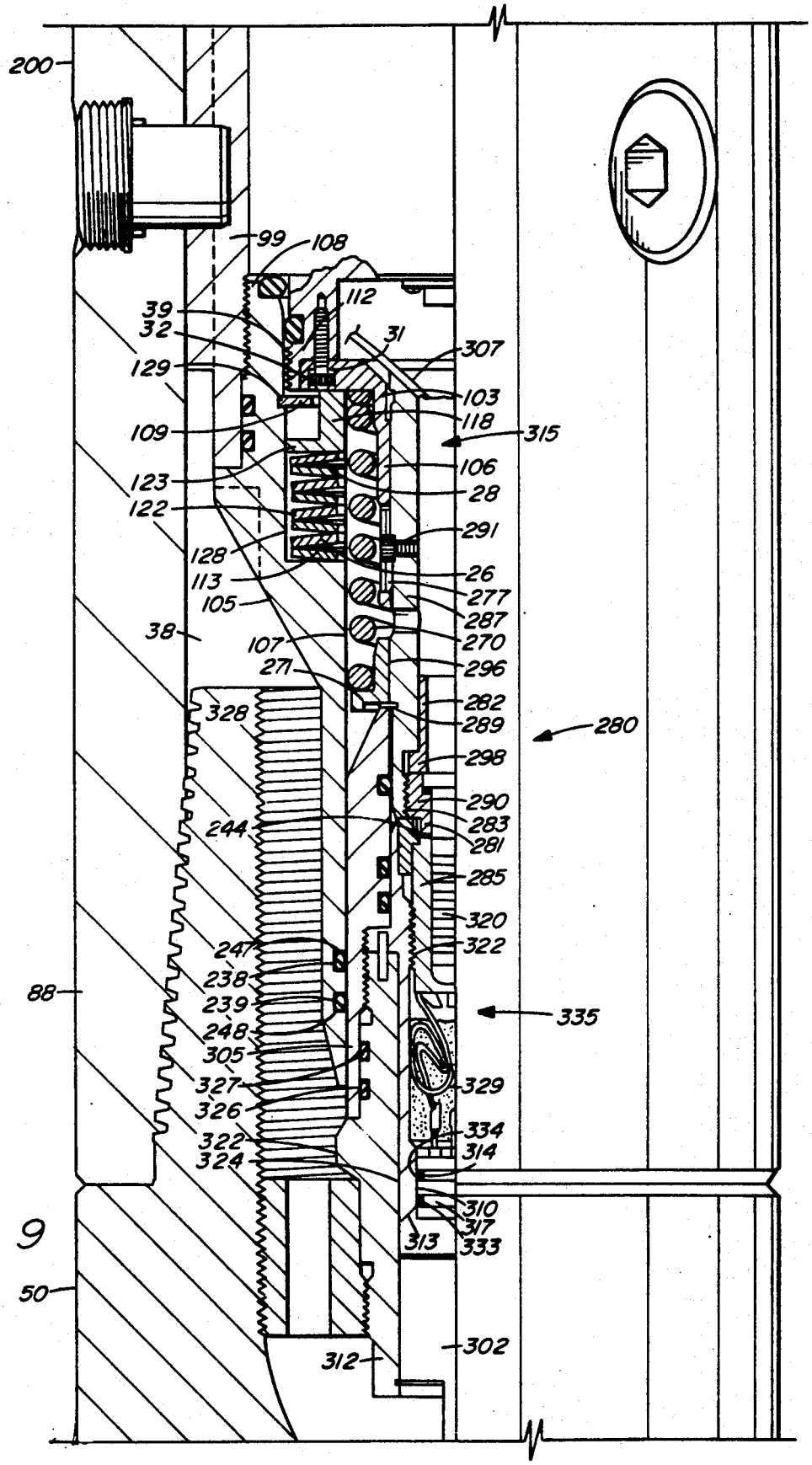
FIG. 9 is a view, partly in vertical section and partly in elevation, of the interconnection of the extended sub to the bit.

Referring now to FIGS. 8 and 9, the extended sub 200 preferably comprises a hollow cylindrical chamber with an interior defined by a first reduced diameter bore section 33, a second larger diameter bore-back section 47 and an intermediate bore section 43 providing a stepped transition from the reduced bore section 33 to the enlarged bore-back section 47. The lower or downhole end 38 of the bore-back section 47 is internally threaded to form a box connection 88, while the upper end 36 of the reduced diameter bore section 33 terminates in a pin connection. The intermediate bore section 43 includes a first inclined surface 52 connecting the bore-back section 47 to the intermediate section 43, and a second inclined surface 54 connecting the intermediate section 43 to the reduced diameter bore section 33.

The exterior of the sub 200 preferably comprises a generally cylindrical configuration and includes an annular shoulder 221 at approximately the longitudinal midpoint for supporting the sensor antenna 25. A transverse borehole 29 is included in the intermediate section 43 for providing a passage for an electrical connection from the interior of the sub 200 to the antenna 25.

The borehole 29 extends from the exterior of the sub 200, near shoulder 221, into the intermediate bore section 43 of the sub. The borehole 29 includes an outer threaded recess portion for receiving a pressure feed-through 190, such as a KEMLON 16-B-980/K-25-BMS or equivalent device. The feed-through 190 includes a feed-through receptacle 183 and a contact stem 186. The feed-through receptacle 183 preferably comprises a shaft 84 and a head 89. The head 89 of the receptacle 183 includes external threads to mate with the threaded recess portion of borehole 29. A plurality of O-rings preferably encircle the shaft 84 of receptacle 183 to seal the borehole 29 against the receptacle 183. The interior of the receptacle 183 includes a teflon jacket, or an equivalent insulator, surrounding the electrically conductive contact stem 186, which resides therein. The inner end of the contact stem 186 includes a banana jack connector 149, which is received in a female receptacle 192 in an insulator 161, inside sub 200. The outer end of the contact stem 186 connects to an electrical conductor 60 that forms the coil of the antenna 25. A pipe plug 69 is embedded in the sub 200 adjacent the feed-through 190 to provide access to the region defined by shoulder 221.

The sub 200 also includes three tandem transversely extending bores 72 spaced equidistantly about the circumference of the sub 200 at approximately the longitudinal midpoint of the bore-back section 47. The bores 72 extend from the exterior of the sub 200 to the bore-back section 47, and include an enlarged threaded recess 134 on their exterior ends.

1. Pressure Bottle

Referring now to FIGS. 6 and 8, the pressure bottle container 99 extends through the interior of the extended sub, in the reduced diameter bore section 33, the intermediate bore section 43 and the bore-back section 47. As the name implies, the pressure bottle container 99 has a controlled pressure to provide a contaminant-free environment for the sensor module circuitry housed therein.

The pressure bottle container 99, in appearance, roughly resembles a long-neck bottle and houses the EM sensor module 125 and the associated battery pack 55. The interior of the pressure bottle container 99 preferably comprises a large diameter module housing 141 and a smaller diameter bottle neck portion 147. The transition between the module housing 141 and the bottle neck portion 147 comprises two shoulders 171, 173, to provide two internal steps between the interior of the module housing 141 and the interior of the bottle neck portion 147.

The upper or uphole exterior of the bottle neck portion 147 includes a support spider arrangement 111 which engages the interior of the reduced diameter bore section 33 of the sub 200 to provide lateral support for the container 99 within the interior of the sub 200. Radially outwardly extending portion 98 also is provided in the larger diameter module housing 141. The lower extending portion 98 engages the interior of the sub 200 to provide lateral and torsional support for the pressure bottle container 99.

In addition, three blind, transverse recesses are located in the exterior face of the extending portion 98, in alignment with transverse bores 72 in the sub 200, to receive the inner ends of electrically-conductive anchor pins 257 which are threaded into recesses 134 and extend through the bores 72. In addition to orienting and providing support for the pressure bottle container 99, the anchor pins 257 also provide a current path from the exterior of the sub to the pressure bottle container 99 through annular rib 98, as will be described more fully, infra.

The container 99 includes an intermediate shoulder region 96 on its exterior surface for engaging the intermediate bore section 43 of the sub 200. The intermediate shoulder region 96 includes a borehole 148 therethrough for receiving the feed-through 190. The module housing 141 of the pressure container 99 includes two orientation guide pins 101 that are secured in the housing 141 at the upper end thereof. The bottom or downhole end of the module housing 141 includes internal threads for receiving a bottle cap retainer 105.

2. Battery Pack

Housed within the bottle portion of pressure container 99 is the battery pack 55 for supplying power to the sensor circuitry. The battery pack 55 preferably comprises a "stack" of two "double D" (DD) size lithium battery cells, encased in a fiberglass tube 131 with epoxy potting, having power and power-return lines terminating at a single connector 119 on the lower or downhole end of the battery pack 55. In the preferred embodiment, the connector 119 comprises an MDM connector. The battery pack 55 preferably includes conventional integral short circuit protection (not shown), as well as a single integral series diode (not shown) for protection against unintentional charging, and shunt diodes across each cell (not shown) for protection against reverse charging, as is well known in the art.

The top end of the sensor module 125 preferably is configured such that the battery pack can be connected and disconnected, both mechanically and electrically, at a field site, for the primary purposes of turning battery power on and off, and replacing consumed battery packs.

3. EM Sensor Module

Figure 8B:
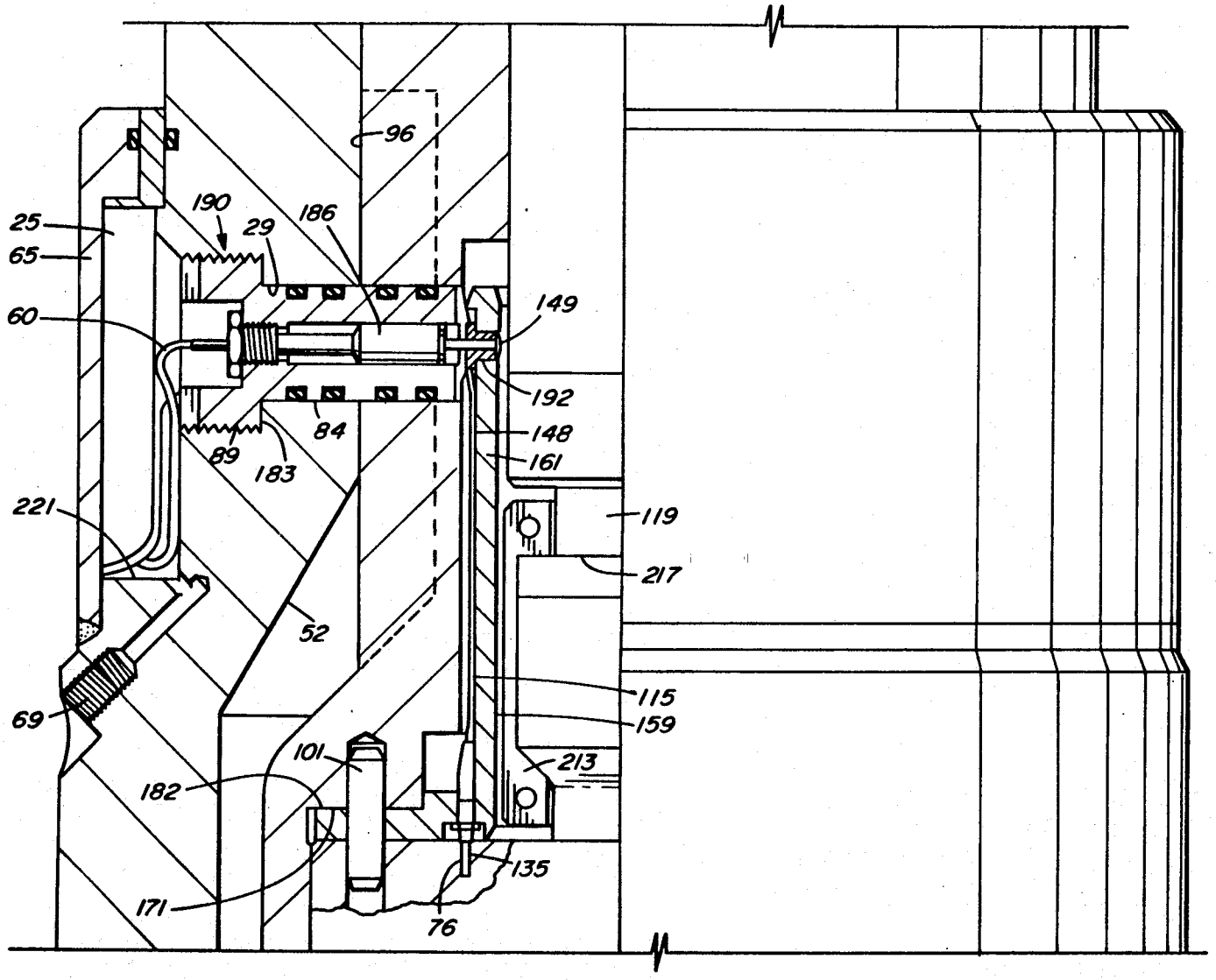
FIG. 8B is an enlarged view, partly in vertical section and partly in elevation, of the midportion of the extended sub as shown in FIG. 8.
Figure 16:
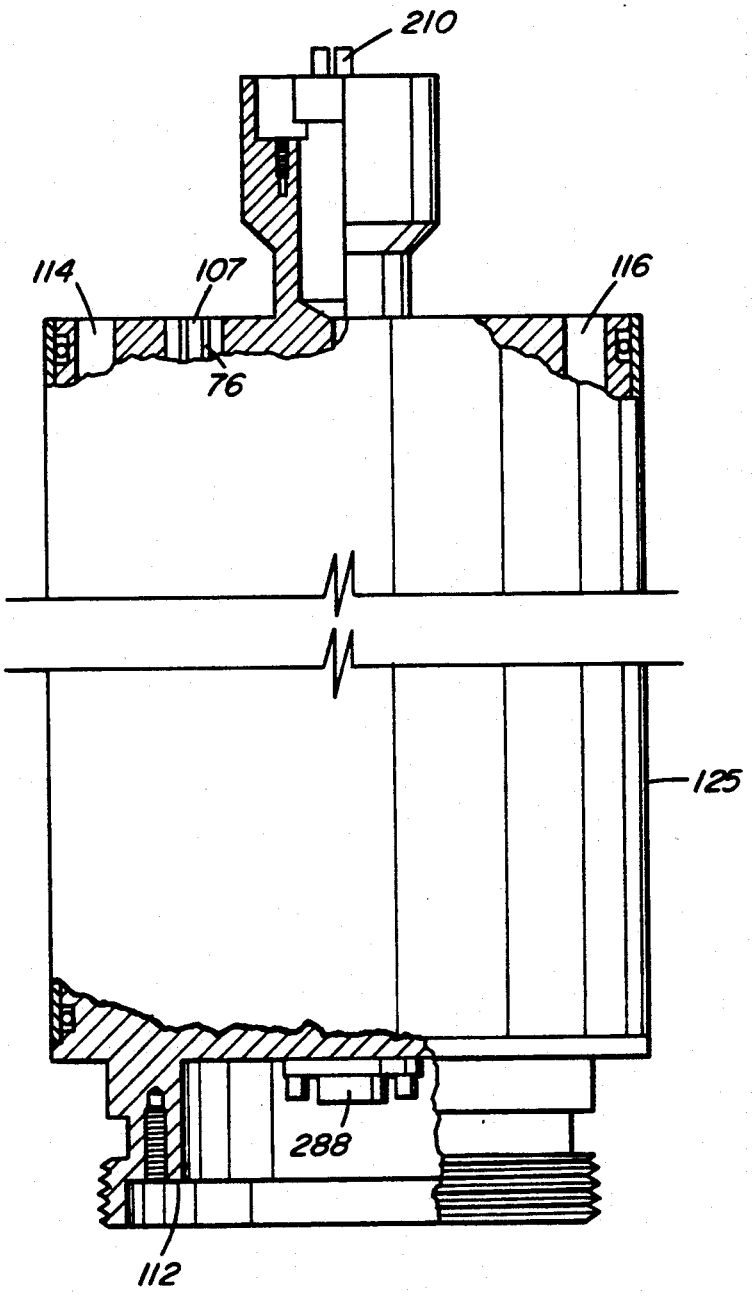
FIG. 16 is a fragmentary elevation, partly in section, with some parts broken away, of the EM sensor module of FIG. 6.

Referring to FIGS. 8, 8B, and 16, the EM sensor module 125 constructed in accordance with the preferred embodiment comprises a generally cylindrical configuration constructed of aluminum, with a non-conductive coating such as fiberglass.

The sensor module 125 resides primarily within the bore-back section 47 of the sub 200 and houses the sensors and associated processing circuitry. The sensor module 125 includes at the upper or uphole end a plug-type connector 210 which extends into the bottle portion of the container 99 to mate with the battery pack 55. As shown in FIG. 8, a front clamp 213 and a rear clamp 217 maintain the battery pack 55 in contact with the connector 210.

In addition to the plug-type connector 210, the upper end of the sensor module 125 also preferably includes two boreholes 114, 116 which receive the orientation guide pins 101 mounted in the module housing 141 of the bottle container 99. The orientation guide pins 101 establish the orientation of the sensor module 125 upon insertion into the pressure container 99, and also provide support for the sensor module 125 during operation.

A third borehole 107, also in the upper end of the sensor module 125 defines the female receptacle 76 for a banana jack connector 135 which forms part of the electrical connection between the sensor module 125 and antenna 25. The configuration of the guide pins 101 and mating banana jack connector 135 preferably is such that the sensor module 125 may only be oriented in one way to fit into the pressure bottle container 99.

A module housing insulator 161 provides insulation and stability to the EM sensor module 125. The insulator 161 comprises a cylindrical portion 159 with a flange 182 at the lower or downhole end. The flange 182 preferably includes two holes through which the registration guide pins 101 are received, and four additional holes for receiving screws to secure the insulator 161 to the bottle container 99 at shoulder 171.

The insulator 161 includes a banana jack connector 135 protruding perpendicularly from the flange. The banana jack connector 135 connects electrically to an electrical conductor 115 embedded in the cylindrical portion 159 and extends longitudinally along the length of the cylindrical portion to an electric terminal 192. In the preferred embodiment, the electric terminal 192 preferably comprises a female receptacle for a second banana jack connector 149. The electric terminal 192 is positioned on the insulator 161 to lay directly opposite the banana jack connector 149 of pressure feed-through 190. The banana jack connector 149 connects to electric terminal 192 and to the electrical stem 186 of the pressure feed-through 190. The electrical stem 186, in turn, electrically connects to conductor coil 60 of the antenna 25

The lower or downhole end of the sensor module 125 includes a plug connector 288 for providing an electrical input/output terminal to the bit sensors. In addition, the lower end of the sensor module 125 includes a conductive ring 112 which forms part of a return current path from the antenna 25.

Housed within the sensor module 125 are the sensors and various supporting electrical components. The sensors preferably include environmental acceleration sensors, an inclinometer and a temperature sensor.

The environmental acceleration sensors, according to techniques which are well known in the art, preferably measure shock and vibration levels in the lateral (x-axis), axial (y-axis), and rotational (z-axis) regions. The lateral region ($A_x$) includes information regarding linear acceleration with respect to the sub, in a fixed cross-axis orientation. The axial region ($A_y$) includes information regarding linear acceleration in the direction of the sub axis. The rotational region ($\alpha_z$) includes information regarding angular acceleration about the sub axis.

The inclinometer, also well known in the art, preferably comprises a three axis system of inertial grade ($\pm 1$ gf/s-sensing) servo-accelerometers, which measures the inclination angle of the sub axis (or driveshaft axis, in the alternative embodiment of FIG. 4), below the motor 100 and very close to the bottom of the well. The accelerometers are mounted rigidly and orthogonally so that one axis (z) is aligned parallel with the sub axis, and the other two (x and y) are oriented radially with respect to the sub. The inclinometer preferably has the capability to measure inclination angles between zero and 180 degrees.

Referring now to FIGS. 8 and 9, the sensor module 125 preferably is maintained in position within the pressure bottle container 99 by a spring mechanism 215, preferably comprised of a load flange 103, a retaining ring 109, a load ring 118, a stack of Belleville springs 122, and a bottle cap retainer 105.

The load flange 103 preferably has an L-shaped cross-sectional configuration with a cylindrical body 106 and a radially outwardly extending annular flange 39 around its upper end. The annular flange 39 includes eight holes 31 circumferentially spaced around the flange 39 to receive screws 32 with lock washers. The load flange 103 is secured to the conductive ring 112 on the lower end of the sensor module 125 by the screws 32 with lock washers. The cylindrical body 106 extends inside of retaining ring 109, load ring 118, and Belleville springs 122, into the interior of the bottle cap retainer 105. The load ring 118 preferably has an upper body of annular configuration and a radially outwardly extending shoulder or flange 123 around its lower end, defining, along with the bore wall of bottle cap retainer 105, an annular space in which the retaining ring 109 resides.

The bottle cap retainer 105 preferably has a generally funnel-shaped configuration with an elongated lower spout having a central axial bore 117 therethrough, in communication with a larger diameter bore 128 through the funnel body-shaped upper end. The central axial bore 117 and the larger diameter bore 128 define a shoulder 113 therebetween. The upper exterior 108 of the bottle cap retainer comprises an externally threaded pin connection which mates with the interior threads at the downhole end of the pressure bottle 99. The cap retainer 105 also includes an annular recessed slot 129 within the larger diameter bore 128 for receiving retaining ring 109. The bottle cap retainer also includes grooves for receiving O-rings to seal the cap retainer 105 against the pressure bottle container 99. In addition, the bottle cap retainer includes grooves 247, 248 for receiving O-rings 238, 239 to seal the cap retainer 105 against the retainer 305 of the drill bit 50.

The spring mechanism 215 is assembled by orienting the concave surface 28 of each Belleville spring 26 to face the concave surface of an adjacent spring so that the stack of Belleville springs 122 is defined by pairs of opposing Belleville springs. The stack of Belleville springs 122 then is placed within the bottle cap retainer 105 to abut the lower face of flange 123 of load ring 118. The retaining ring 109, which comprises a C-shaped or split ring, is positioned within the slot 129 in bottle cap retainer 105 to secure the Belleville springs 122 and the load ring 118, through the Belleville springs, within the cap retainer 105. The bottle cap retainer 105 then is screwed into the pressure bottle container 99, with shoulder 113 forcing the load ring 118, through the Belleville springs, into contact with the load flange 103, and placing the stack of Belleville springs 122 into compression.

Referring still to FIGS. 8 and 9, the bottle cap retainer 105, the Belleville springs 26, the load ring 118 and the load flange 103 are all electrically conductive and form part of a current path from the antenna 25 to the conductive ring 112 on the lower end of the sensor module 125. As will be discussed infra, the rest of the current path comprises the antenna shield 65, the sub 200, and the anchor pins 257.

4. Sensor circuitry

Figure 13:
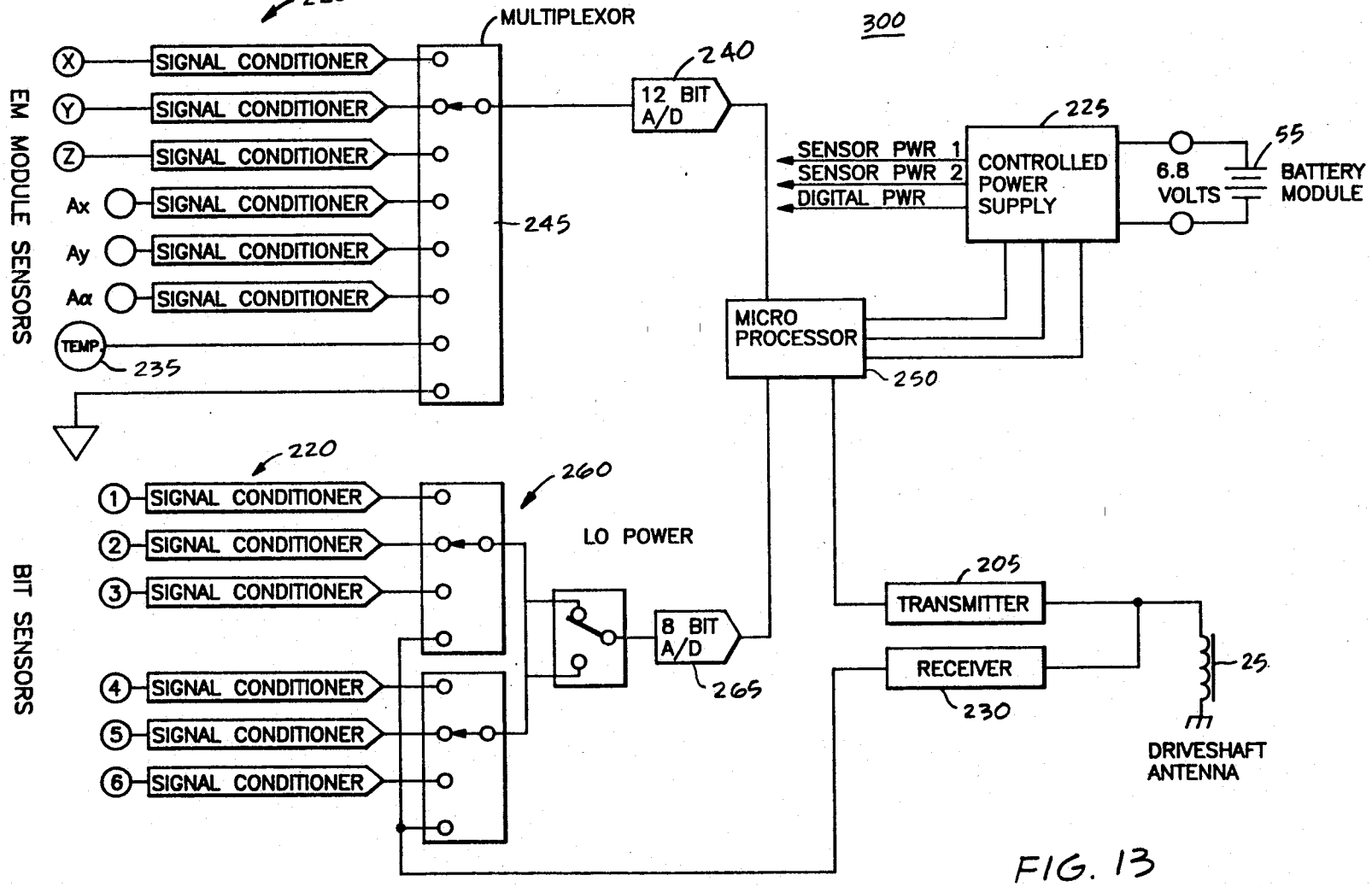
FIG. 13 is a schematic illustration of the sensor module circuitry.

Referring now to FIG. 13, the EM sensor module circuitry 300 preferably includes a microprocessor 250, a transmitter 205 and receiver 230, both of which connect electrically to the sensor antenna 25, signal conditioning circuitry 220, a controlled power supply 225 connected to the battery pack 55 and various sensors for measuring environmental acceleration, inclination and temperature.

The EM sensor module circuitry 300 preferably includes the following sensors within the EM sensor module 125: (1) three inclinometer sensors, shown as X, Y, Z in FIG. 13; (2) three environmental acceleration sensors, shown as $A_x$, $A_y$, $A_\alpha$; and (3) a temperature sensor 235. In addition, the sensor circuitry 300 may receive up to six input signals from sensors positioned in the bit. In the preferred embodiment, the bit sensors measure temperature and wear in the bit.

Referring still to FIG. 13, the output signals from the inclinometer sensors and environmental acceleration sensors are fed to conventional signal conditioning circuitry 220 to amplify the signals and remove interference from the signal. The signals, together with the output signal from the temperature sensor 235, are input to a multiplexor 245. In the preferred embodiment, the multiplexor 245 comprises an 8:1 multiplexor.

The multiplexor 245 selects one of the output signals according to conventional techniques and connects the selected signal to a 12 bit analog-to-digital converter 240. The digital output signal from the analog-to-digital converter 240 is fed to the microprocessor 250, which preferably comprises a MOTOROLA 68HC11 or equivalent device.

Similarly, the output signals from the bit sensors are supplied as input signals to the signal conditioning circuitry 220, and then relayed to a multiplexor 260. The multiplexor 260 may comprise a cascaded multiplexor circuit, with two 4:1 multiplexors in series with a 2:1 multiplexor.

The output signal from the multiplexor 260 is supplied to an 8 bit analog-to-digital converter 265, the output of which connects to the microprocessor 250. In the preferred embodiment, multiplexor 260 and analog-to-digital converter 265 are included as part of the internal hardware and software of the microprocessor 250.

The receiver 230 connects electrically to antenna 25 to receive command signals from the EM control module 40. The output of the receiver 230 connects electrically to the input of the multiplexor 260, which in the preferred embodiment, is integral with the microprocessor 250. The command signal is converted to a digital signal in analog-to-digital converter 265, and then is processed by the microprocessor 250 to retrieve the message transmitted from the control module 40.

Similarly, the signals from the EM module sensors and bit sensors are digitized and processed by the microprocessor 250 and the processed signals then are stored in memory until needed. The processing preferably includes formatting and coding the signals to minimize the bit size of the signal. Additional memory may be included in the sensor circuitry 300 to store all of the sensed signals for retrieval when the sensor module 125 is retrieved from downhole.

Once it is determined that the processed sensor signals are to be transmitted uphole, which preferably is upon command from the control module 40, the microprocessor 250 retrieves some or all of the processed signals, performs any additional formatting or encoding which may be necessary, and outputs the desired signal to the transmitter 205. The transmitter 205 connects electrically to antenna 25 and provides a signal to the antenna 25, at a frequency determined by the EM sensor microprocessor, which in turn causes the transmission of an EM signal that is received at the control antenna 27.

Power for the EM sensor circuitry 300 is obtained from the controlled power supply 225. The power supply 225 connects across the battery pack 55 and receives dc power therefrom. The power supply 225 converts the battery power to an acceptable level for use by the digital circuits. In the preferred embodiment, the battery 55 supplies power at 6.8 volts dc.

5. Antenna

Referring now to FIGS. 6, 8, and 8B, a sensor antenna 25 is mounted on the outside of the sub 200, on annular shoulder 221. The transformer-coupled, insulated gap antenna 25 thus is exposed to the mud stream within the wellbore.

As is well known in the art, the transformer includes a core 63 and a coil 60 wrapped around the core. The core 63 of the antenna 25 preferably is constructed of a highly permeable material, such as an iron/nickel alloy. In the preferred construction, the alloy is formed into laminated sheets coated with insulation such as magnesium oxide, wound about a mandrel to form the core, and heat treated for maximum initial permeability.

Referring still to FIG. 6, the electrical conductor 60 is wound about the core 63 to form the coils of the antenna 25. In the preferred embodiment, the conductor 60 comprises a thin copper strip, with a width of approximately 0.125 inch and a thickness of approximately 0.002 inch, sheathed in CAPTON, or any other suitable dielectric material.

Referring again to FIGS. 6, 8, and 8B, the sensor antenna 25 preferably is vacuum-potted in an insulating epoxy and positioned adjacent the shoulder 221 of sub 200. In the preferred embodiment, the epoxy comprises TRA-CON TRA-BOND F202 or equivalent. The electrical conductor 60 passes through the epoxy to connect electrically to the contact stem 186 of the pressure feed-through 190. An annular protective cover or shield 65 houses the antenna 25.

The protective cover 65 preferably is constructed of steel, or some other suitable conductive material, and the antenna 25 is bonded to the cover or shield 65 by a suitable insulating epoxy. In the preferred embodiment, the latter epoxy also comprises TRA-CON TRA-BOND F202 or equivalent. The electrical conductor 60, after it is wound about core 63, passes through the epoxy, and connects to the shield 65. The protective cover or shield 65 is welded or otherwise secured in place on the sub 200. It may be desirable to isolate the interior of the shield 65 from the wellbore environment through suitable seals or other isolating means.

6. Connector assembly

Referring now to FIG. 9, a connector assembly 280 mounted at the lower end of the EM sensor module 125 provides the electrical connection between the drill bit 50 and the EM sensor module 125. The connector assembly 280 preferably is constructed to permit connection or disconnection of bit sensors in a field environment, as required to interchange drill bits, EM sensor modules, and/or battery packs.

The connector assembly 280 preferably comprises a sub connector sub-assembly 315, associated with the sensor sub 200, and a bit connector sub-assembly 335, associated with the drill bit 50. The sub connector sub-assembly 315 preferably comprises the male portion of a BEBRO ELECTRONIC seven conductor connector or equivalent 320, a coil spring 270, an adaptor 287, a load flange 296 and a retaining ring 289.

The adaptor 287 is secured to the cylindrical body 106 of load flange 103 by a screw 291. The screw extends through a longitudinal slot 277 in the body 106 of load flange 103 and is received in a threaded recess in the adaptor 287. Although secured to load flange 103, the adaptor 287 may move longitudinally as the screw 291 moves in the slot 277.

The coil spring 270 encircles the load flange 103, with its upper end bearing against the flange portion 39 of load flange 103. The coil spring 270 resides inside the Belleville springs 122 and extends into the central bore of the bottle cap retainer 105. The load flange 296 encircles the adaptor 287 and the radially outwardly extending flange portion 271 of load flange 296 abuts the bottom of coil spring 270. The retaining ring 289 abuts and supports the load flange 296 and is secured in place in a recess in the exterior surface of adaptor 287.

When the drill bit 50 is fully mated with the sensor sub 200, the retainer 305 of the drill bit 50 bears against the retaining ring 289, causing screw 291 to slide longitudinally upward in slot 277. As the screw 291 moves upward, so too does the adaptor 287 and load flange 296, thus putting the coil spring 270 into compression. In this manner, the connection assembly is spring loaded.

The male portion of the BEBRO connector 32 is secured within the central bore of adaptor 287 by a support flange 282, the flange portion 298 of which resides in shoulder 290 of adaptor 287, and a lock ring 283 which bears against flange portion 298. The lock ring 283 has a stepped internal and external configuration. The external portion of the lock ring 283 is threaded to engage internal threads in the lower box end of adaptor 287. The lock ring 283 captures an externally projecting flange 297 on the male portion of the BEBRO connector 320 between its internal shoulder and the lower flange portion 298 of support flange 282. The male portion of the BEBRO connector 320 includes pin contacts at its upper end that electrically connect to a harness of insulated electrical conductors 307, which in turn, connect to the connector 288 of the EM sensor module 125.

The bit connector sub assembly 335 preferably comprises a retainer 305, a receptacle 310 securing the female portion of a BEBRO connector 285, a coupling connector 312, a high pressure feed-through 317 and a contact block 302.

The coupling connector 312 resides partially within the drill bit 50 and includes a gripping surface 322, grooves 326, 327, and an interior bore 324 along its longitudinal axis. The contact block 302 is secured in the drill bit 50 within the interior bore 324 of the coupling connector 312. The contact block 302 houses electrical conductors which connect to the six sensors in the drill bit 50.

The receptacle 310 resides partially within the interior bore 324 of the coupling connector, with the bottom end of the receptacle 310 bearing against the contact block 302. The upper end of the receptacle 310 extends out of the interior bore 324 to lay within the retainer 305. The receptacle 310 includes a central bore 322 in which the female portion of the BEBRO connector 285 and pressure feed-through 317 reside.

Two O-rings 333, 334 reside in grooves 313, 314 in feed-through 317 to seal the feed-through 317 within the central bore 322 of the receptacle 310. The pressure feed-through 317 connects to an electrical conductor 329 at its upper end and to contact block 302 at its lower end, and includes a contact stem to provide an electrical connection between the conductor 329 and the contact block 302. The conductor 329 connects electrically to the female portion of the BEBRO connector 285.

The retainer 305 includes an axial bore extending longitudinally therethrough in which the receptacle 310 and BEBRO connector 285 reside. The retainer also includes a plurality of grooves containing O-rings and a bearing surface 328 at its upper end.

When the drill bit 50 is connected to the sensor sub 200, retainer 305 passes within the central bore 117 of bottle cap retainer 105, with the upper end surface of retainer 305 engaging the retaining ring 289, causing the load flange 296 to move upward with adaptor 287 and screw 291, placing coil spring 270 into compression. At the same time, the female portion of the BEBRO connector 285 mates with the male portion 320, completing an electrical connection between the bit 50 and the sub 200.

As will be understood by one skilled in the art, various other connectors may be used without departing from the principles disclosed herein. The connector assembly 280 preferably is maintained in a dry environment, protected from operating environmental pressures. In addition, the connector assembly 280, as described, preferably is spring loaded to preserve the integrity of the connection with the drill bit. The connector assembly 280 connects electrically to the EM sensor module 125 assembly. The connector wiring and conductor configuration permits mating and disconnection of the connector while the module is powered up, without causing any damage to the EM module 125.

7. Operation of EM Sensor

Referring now to FIGS. 6, 8, 8B, and 13, the EM sensor module 125 functions to receive commands from the control module 40, via the EM short hop link, and obtains data signals from the various sensors in the sensor module 125 and the drill bit. The sensor module 125 encodes and formats the data as necessary and transmits the data to the control module 40.

The current path between the EM sensor module 125 and sensor antenna 25 is as follows. The transmitter 205 (and receiver 230) connect by a conductor (not shown) to the female receptacle 76 of the EM sensor module 125. A banana jack connector 135 protruding from insulator 161 mates with the female receptacle 76. The banana jack connector 135 connects to the electrical conductor 115 embedded in the insulator 161 and connects to a female receptacle 192. Banana jack connector 149 mates with the receptacle 192, and connects to the contact stem 186 in the pressure feed-through 190. The contact stem 186 connects to the electrical conductor 60, which passes through the epoxy and winds around the annular core 63. The conductor 60 passes through the epoxy to connect to the protective shield 65.

Current returns to the sensor module by passing from the shield 65 to the sub 200, through the anchor pins 257, to the pressure bottle container 99. The current travels through the container 99 to cap retainer 105, Belleville springs 122, load ring 118, and load flange 103, back into the sensor module 125 to a suitable ground within the sensor module 125.

B. Control Sub

Referring now to FIGS. 3, 10A, 10B, 10C, 11, and 12, the EM control sub constructed in accordance with the preferred embodiment comprises a transceiver sub 45, with a control antenna 27 mounted thereon, and a control module 40 engaging and extending from the transceiver sub 45. In the preferred embodiment, a guard sub 70 is provided on the downhole side of the transceiver sub 45.

1. Transceiver Sub

The transceiver sub 45 preferably includes a standard pin connection 81 at the downhole end 83 that threadingly engages a box connection 94 on the uphole side of the guard sub 70. The uphole end 97 of the transceiver sub 45 also preferably includes a pin connection 93 for mating with a sensor sub 80, such as a gamma, resistivity, or weight-on-bit sub. Alternatively, the transceiver sub 45 could mate on its upper or lower ends with a host sub, a telemetry sub, such as a mud pulser, or with a drill collar. The downhole end of the guard sub (not shown) includes a standard pin connection which preferably engages the mud pulser collar 35.

Referring now to FIGS. 10A, 10B, 10C, and 11, the transceiver sub 45 preferably has a generally cylindrical exterior configuration, except that sub 45 includes a double shoulder 48, 49 and two rib sections 51, 53 in its mid-portion. The double shoulder preferably includes an annular arcuate shoulder 48 adjacent an annular angular shoulder 49. Arcuate shoulder 48 preferably houses the control antenna 27, while the angular shoulder 49 receives an antenna shield 75. The rib sections 51, 53 both include longitudinal ribs to provide a gripping surface during make-up and also provide support for the sub 45 downhole.

The interior of the transceiver sub 45 includes a central bore 62 extending from the downhole end approximately halfway along the longitudinal length of the sub 45, to a point approximately in the region of the double shoulder 48, 49. Six bores 59 equidistantly spaced in a circular pattern extend longitudinally from the uphole end face 67 of the pin connection 93 of transceiver sub 45, to intersect the central bore 62. Thus, each of the bores 59 is in fluid communication with the central bore 62.

The upper end face 67 of transceiver sub 45 preferably includes a hollow shaft 57 extending therefrom. The hollow shaft 57 extends from the center of uphole end face 67, inside the circular pattern defined by bores 59. The shaft 57 includes a lower, larger diameter segment 64 separated from an upper, smaller diameter portion 68 by a shoulder. The larger diameter segment 64 is integrally connected to the transceiver sub 45, and includes, at the base, recesses around its exterior surface for receiving O-rings, and exterior threads for mating with the EM control module 40. The smaller diameter segment 68 also includes exterior threads.

A small bore 77 extends longitudinally through the center of the hollow shaft 57 and through the center of the transceiver sub 45 to a point near the central bore 62. The transceiver sub 45 also includes a bore 92 extending from the small bore 77 at approximately a forty-five degree angle to exit at an inclined recess communicating with the arcuate shoulder 48. A pressure feed-through 82, similar to feed-through 190 in the sensor sub 200, resides in bore 92 to provide an electrical connection from bore 77 to the control antenna 27.

An electrical conductor 86, preferably comprising a multi-strand copper wire encased in teflon, is positioned in the bore 77. The conductor 86 connects to the interior contact of the pressure feed-through 82, and extends the length of the bore 77 to another pressure feed-through 91 at a position within the hollow shaft 57. Cotton preferably is provided within the bore 77 to provide insulation and to cushion the conductors to prevent excessive jarring.

Pressure feed-through 91 fits within an annular groove in bore 77, with an O-ring insuring a proper seal between the feed-through 91 and the wall of the bore 77. The feed-through 91 connects to an electrical conductor 216 which, in turn, connects to the EM control module 40.

2. EM Control Module and Housing

Figure 10A:
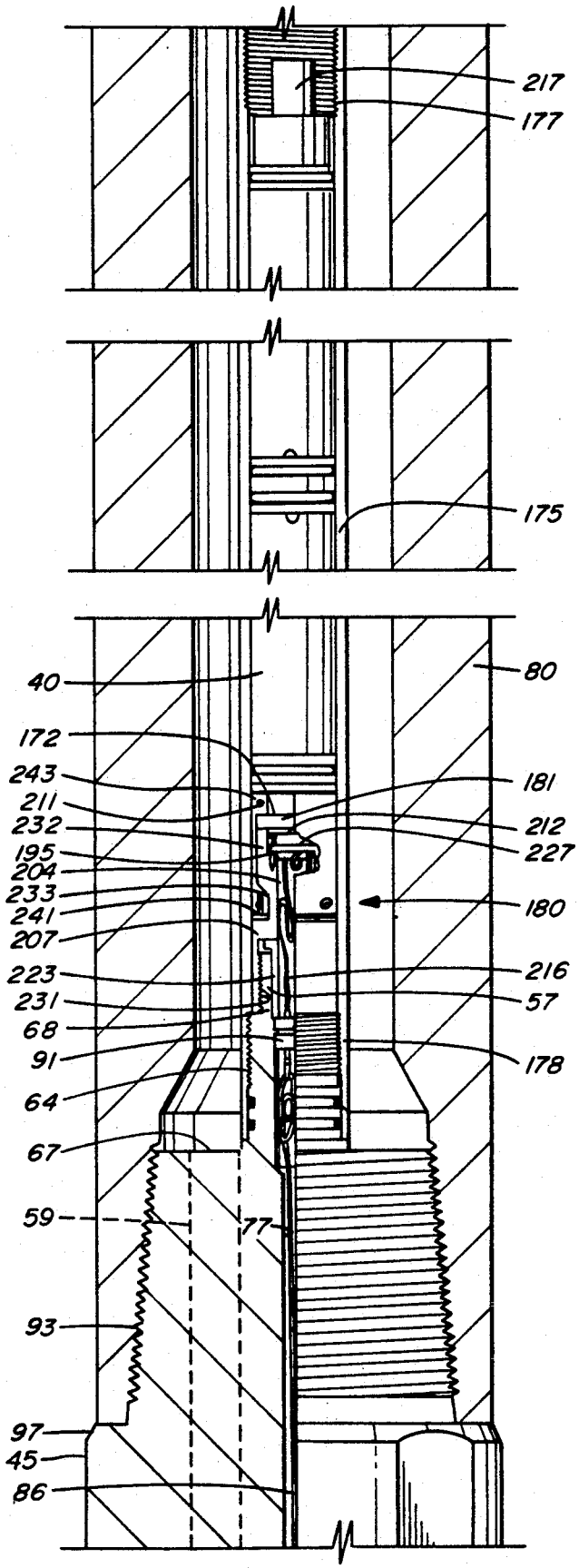
FIGS. 10A–B are views partly in vertical section and partly in elevation of the upper and lower portions, respectively, of the control transceiver sub shown in the preferred embodiment of FIG. 3.
Figure 10B:
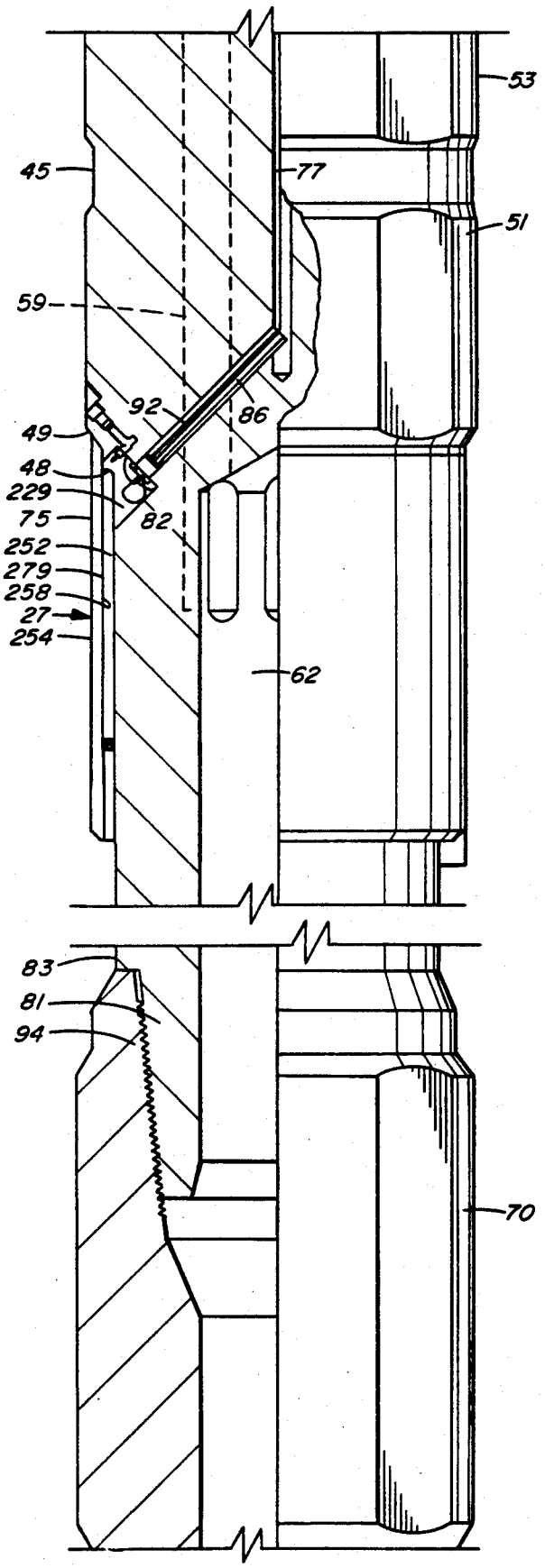
Figure 10C:
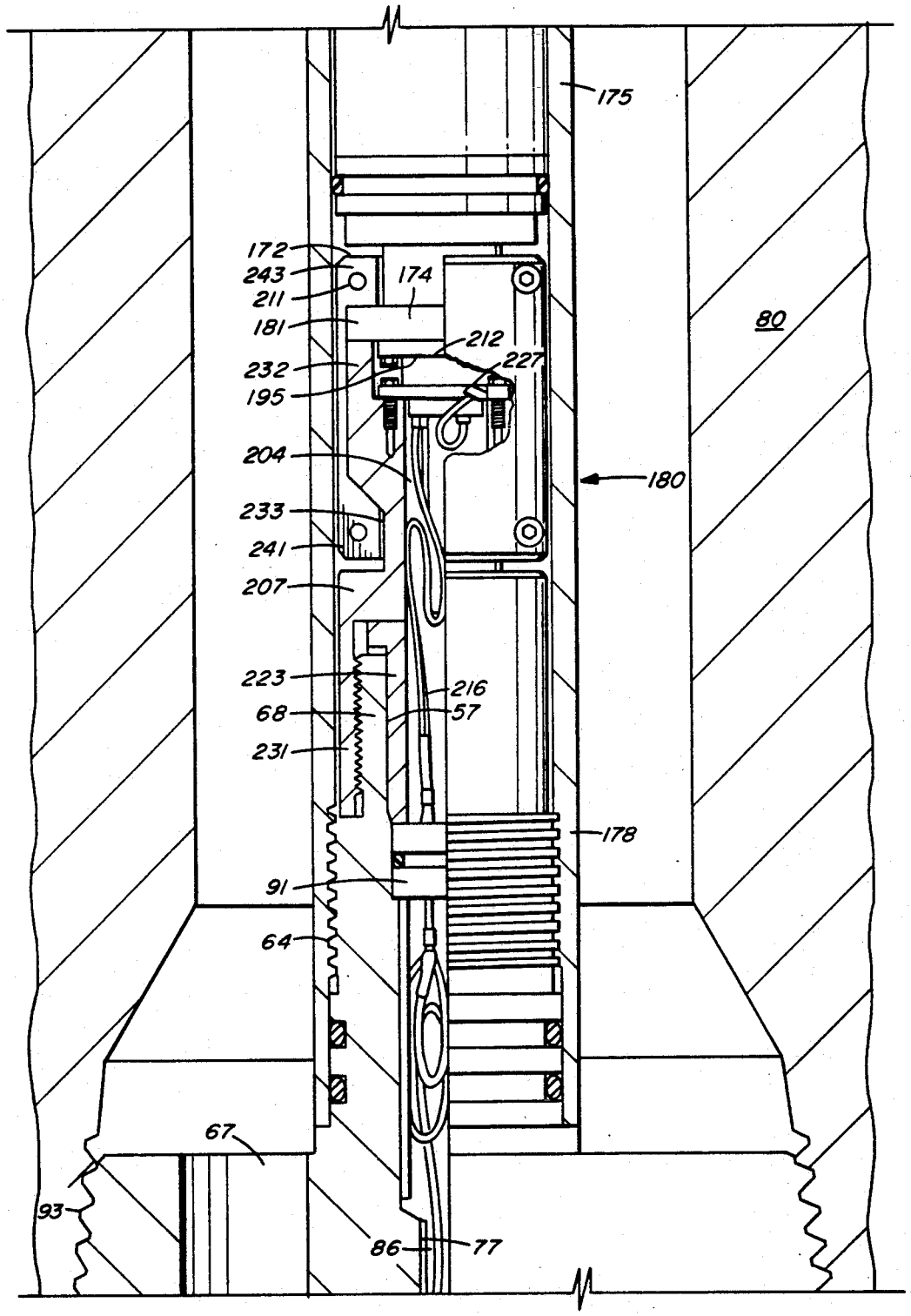
FIG. 10C is an enlarged view, partly in vertical section, partly in elevation, and with some parts broken away, of the midportion of the apparatus shown in FIG. 10A.
Figure 12:
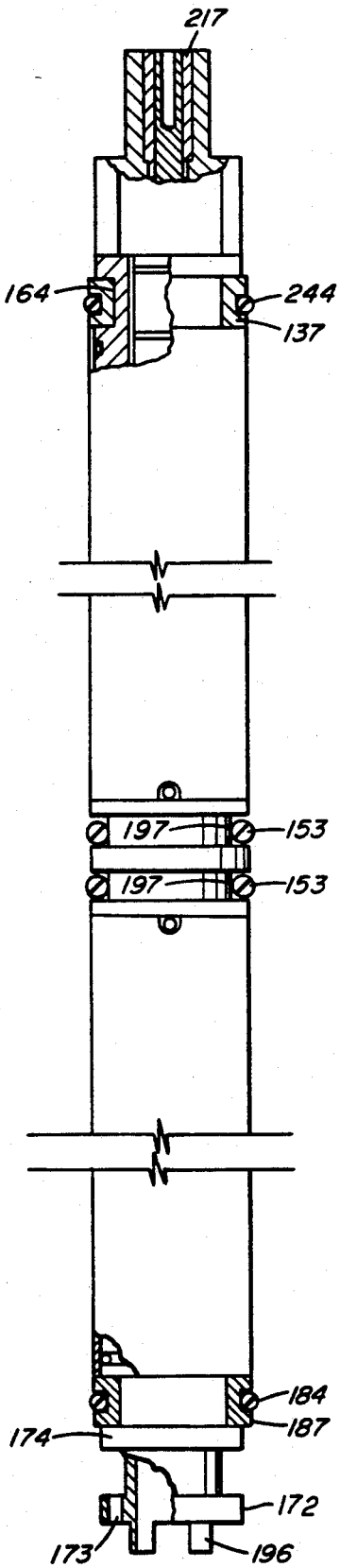
FIG. 12 is a fragmentary elevation, partly in section, and with some parts broken away, of the EM control module of FIG. 10A.
Figure 11:
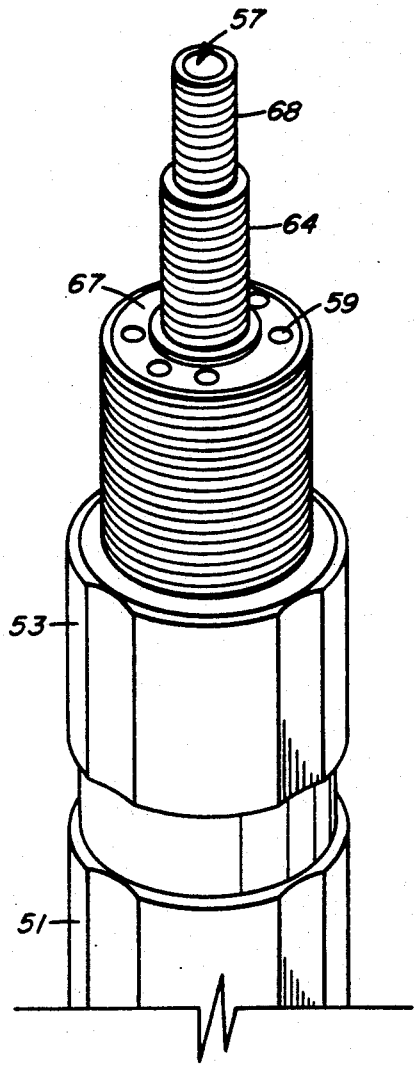
FIG. 11 is an isometric view of the upper portion of the transceiver sub of FIG. 10A.

Referring now to FIGS. 10A, 10C, and 12, the EM control module 40 preferably is housed within an elongated pressure barrel 175 and connects physically and electrically to the command transceiver sub 45 through an interconnection assembly 180. The pressure barrel 175 has a uniform tubular configuration, preferably constructed of steel or an equivalent conductive material. In the preferred embodiment, both the uphole end 177 and the downhole end 178 of the barrel 175 are internally threaded, with an annular lip extending longitudinally outwardly from the threaded region.

The EM control module 40 preferably is constructed of aluminum, with the external surfaces black anodized. The aluminum housing preferably is contained in a cover tube of fiberglass, or an equivalent insulator. The control module 40 houses the EM control circuitry.

The EM control module 40 preferably includes an MDM connector 195 at its downhole end for connecting to the electrical conductor 216 from the control antenna 27, and an electrical connector 217 at its uphole end for connecting to a host module or other MWD tool. The downhole end of the control module includes two arcuate protrusions 196 which receive the connector 195.

The downhole end of the EM control module includes a boss portion with first and second radially extending annular flanges 172, 174. The first annular flange 172 includes two boreholes 173 which extend therethrough. In the preferred embodiment, the two boreholes 173 are located outside the arcuate sections 196 and offset from each other approximately 160°. A split retaining ring 187 housing an O-ring 184 around its exterior is disposed between second annular flange 174 and the body of the control module.

The control module 40 also includes two adjacent annular grooves 197, each of which receives an O-ring 153. An annular boss portion 164 also is located at the uphole end of the module. Boss 164 receives a split retaining ring 137, containing an O-ring 244.

3. Control circuitry

Figure 14:
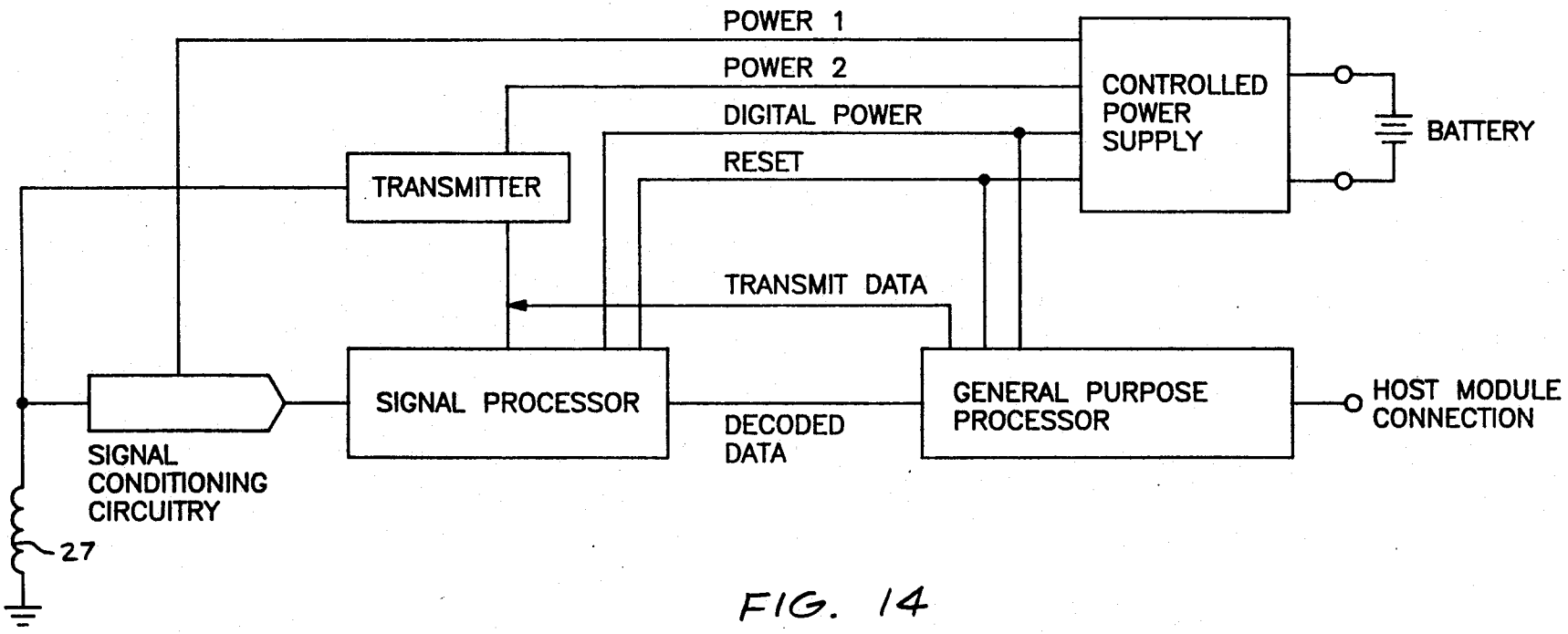
FIG. 14 is a schematic illustration of the control module circuitry.

Referring to FIG. 10A, the EM control module 40 preferably connects to the host module by a single conductor wireline cable. Referring now to FIG. 14, the control module 40 includes signal conditioning circuitry for conditioning the EM data signals received from the sensor module via antenna 27. The conditioned signals are fed to a signal processor which deciphers the encoded signals from the sensor module. The decoded signals then are sent to the general system processor, which relays the data signals to the host module. The system processor also initiates the transmission of signals to the sensor module via transmitter circuitry. Power for the control module circuitry is supplied by a battery module and a controlled power supply.

Figure 15:
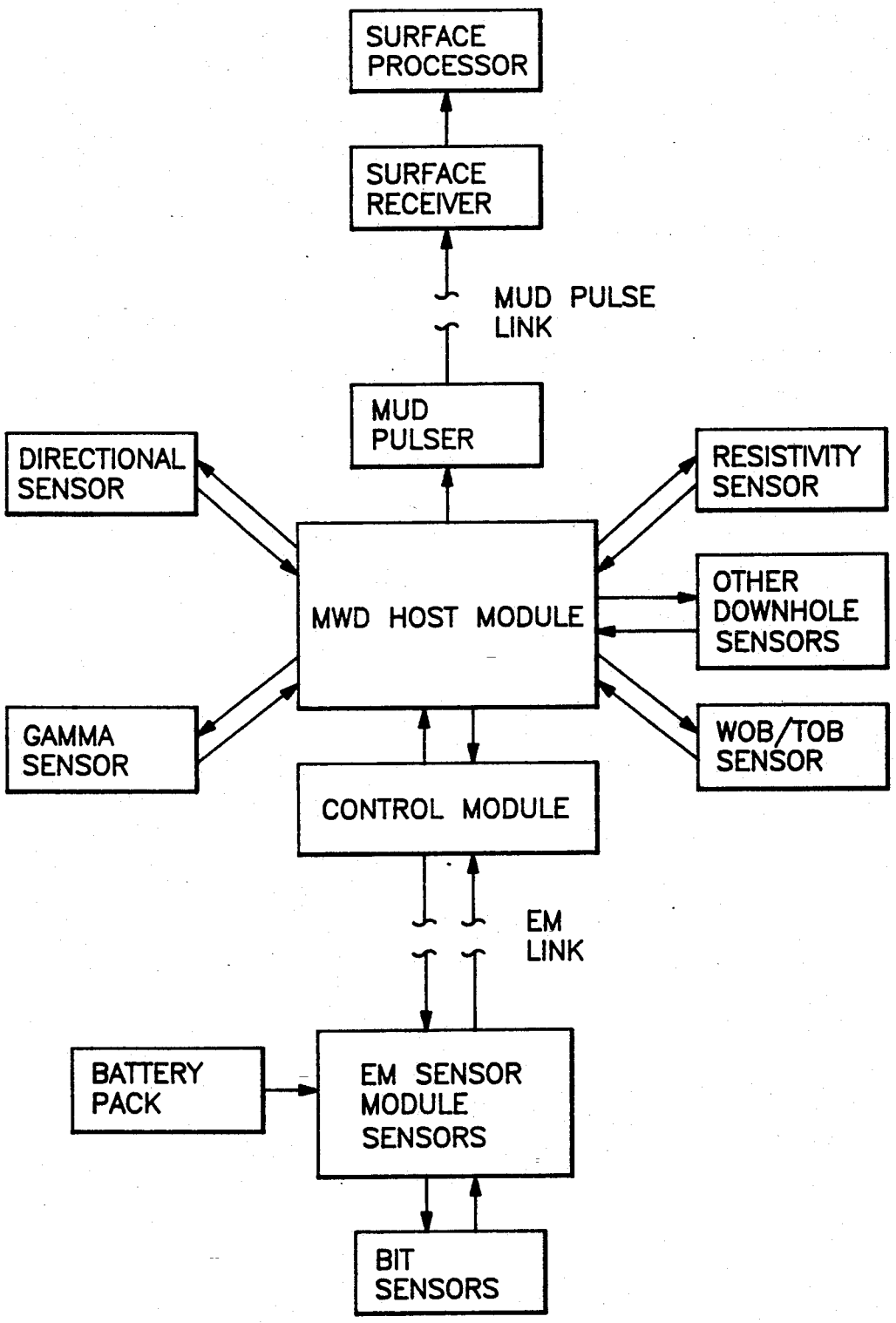
FIG. 15 is a block diagram depicting the electronic and telemetry components of the short hop data telemetry system of FIG. 3.

As shown in FIG. 15, the EM control module preferably includes a hard wired connection to the host MWD module common bus, which also connects to all other MWD sensors. Electrical power for the EM control module is supplied by the bus.

The control module transmits command signals, via the EM data link, to the sensor module ordering the sensor module to acquire data from some or all of the sensors located in the module or bit, and transmit back (via the same EM link) that data. This data preferably is averaged, stored, and/or formatted for presentation to the command module, which in turn, reformats the data for incorporation into a mud pulse transmission mode format and data stream. Higher frequency data, which must be stored in the control module downhole, may be copied and/or played back at the surface after the module is pulled out of the hole.

Communication is established with the EM sensor module as described supra, in Section II, A, 7 "Operation of EM Sensor."

4. Interconnection Assembly

The interconnection assembly 180 physically and electrically connects the transceiver sub 45 to the EM control module 40. Referring now to FIGS. 10A, 10B, and 10C, the interconnection assembly 180 constructed in accordance with the preferred embodiment resides entirely within the pressure barrel 175 and comprises an adaptor 207, a spacer 223, a clamp 211, a connector 195, an electrical conductor 216 positioned within a teflon tubing 204, a pressure feed-through 91, and a fillister screw 227 including a terminal.

As noted supra, the uphole side of the transceiver sub 45 includes a hollow shaft 57 which includes a larger diameter lower segment 64 separated from a smaller diameter upper portion 68 by a shoulder. The pressure feed-through 91 is mounted within the bore 77 of hollow shaft 57, and connects to the electrical conductor 86 from the control antenna 27. The electrical conductor 216 connects at one end to the uphole side of feed-through 91, and at the opposite end to the connector 195. The connector 195, which preferably comprises an MDM connector, resides within an insulated teflon tubing 204.

The spacer 223 preferably includes a body and flange, with the body portion encircling the tubing 204 within the hollow shaft 57, and bearing against a load ring disposed between the lower end of the spacer and the feed-through 91.

The adaptor 207 preferably comprises a full diameter section 231 at the lower end, a reduced diameter section 232 at the upper end, and a groove 233 defined between sections 231 and 232. The full diameter section 231 includes internal threads to mate with the external threads on the smaller diameter segment 68 of hollow shaft 57. The transition between the reduced diameter section 232 and the groove 233 comprises an inclined surface.

The clamp 211 clamps the adaptor 207 to the shoulder 181 of control module 40 and includes a projection 241 on the lower end residing in groove 233, and a projection 243 on the upper end residing between flanges 172, 174. The clamp 211 is maintained in position by the interior surface of the pressure barrel.

The fillister screw 227 mounts to the interior of the reduced diameter section 232 of adaptor 207 and includes an insulated electrical wire which connects to the MDM connector 212.

5. Control Antenna

Referring now to FIGS. 3, 6, and 10B, a control antenna 27, very similar to the antenna 25 for the sensor module 125, is mounted on the outside of the control transceiver sub 45. The primary difference between the control antenna 27 and the EM sensor antenna 25 is that the control antenna 27 preferably comprises two separate cores 252, 254 which have a thinner width than the core 63 used in the sensor antenna 25. The cores 252, 254 are thinner in the preferred embodiment because there is less space available between the transceiver sub 45 and the borehole wall than exists between the sensor sub 200 and the borehole wall.

Because the cores 252, 254 must be thinner than core 63 to fit in the well, a core which is axially longer preferably is used to compensate for the thinner core. For ease of manufacturing, it is preferred that two short cores 252, 254 be used to achieve the necessary length.

The cores 252, 254 are mounted on the shoulder 48 of the control transceiver sub 45. In the preferred embodiment, an insulator 258 is positioned between the stacked cores 252, 254. An electrical conductor 264 wraps around the stacked cores 252, 254, so that cores 252, 254 are treated as a single core structure.

The cores 252, 254 preferably are constructed of a highly permeable material, such as an iron/nickel alloy. In the preferred construction, the alloy is formed into laminated sheets coated with insulation such as magnesium oxide, wound about a mandrel to form the cores, and heat treated to maximize initial permeability.

In the preferred embodiment, the conductor 264 comprises a thin copper strip, with a width of approximately 0.125 inch and a thickness of approximately 0.002 inch, sheathed in CAPTON, or any other suitable dielectric material.

The control antenna 27 preferably is vacuum-potted in an insulating epoxy 229 and positioned adjacent the shoulder 48 of transceiver sub 45. In the preferred embodiment, the epoxy comprises TRA-CON TRA-BOND F202 or equivalent. The electrical conductor 264 passes through the epoxy 229 to connect electrically to the pressure feed-through 82.

An annular protective cover or shield 75 located in shoulder 49 of the transceiver sub 45 houses the antenna 27. The protective cover 75 preferably is constructed of steel, or some other suitable conductive material, and the antenna 27 is bonded to the cover or shield 75 by a suitable insulating epoxy 279. In the preferred embodiment, the epoxy 279 also comprises TRA-CON TRA-BOND F202. The electrical conductor 264, after it is wound about cores 252, 254, passes through epoxy 279, and connects to the shield 75. The protective cover or shield 75 is welded or otherwise secured in place on the transceiver sub 45. Again, the interior of the shield 75 may be isolated from the surrounding wellbore environment.

C. MWD Host Module

Referring now to FIGS. 3 and 15, the MWD host module 10 preferably comprises a microprocessor based controller for monitoring and controlling all of the MWD components downhole. Thus, as shown in the preferred embodiment of FIG. 15, the host module receives data signals from the EM control module, a gamma sensor, a directional sensor, a resistivity sensor, a weight-on-bit/torque-on-bit ("WOB/TOB") sensor, and other MWD sensors used downhole, all of which include their own microprocessor. A bus is preferably provided to connect the MWD host module to the EM control module and the other MWD sensors. In addition, the host module preferably includes a battery to power the host module, and the MWD sensors through the bus line.

The host module preferably transmits command signals to the sensors, such as the EM control module, prompting the sensors to obtain and/or send data signals. The host module receives the data signals and provides any additional formatting and encoding to the data signals which may be necessary. In the preferred embodiment, the host module preferably includes additional memory for storing the data signals for retrieval later. The host module preferably connects to a mud pulser and transmits encoded data signals to the mud pulser, which are relayed via the mud pulser to the surface.

D. Drill Bit

Figure 7:
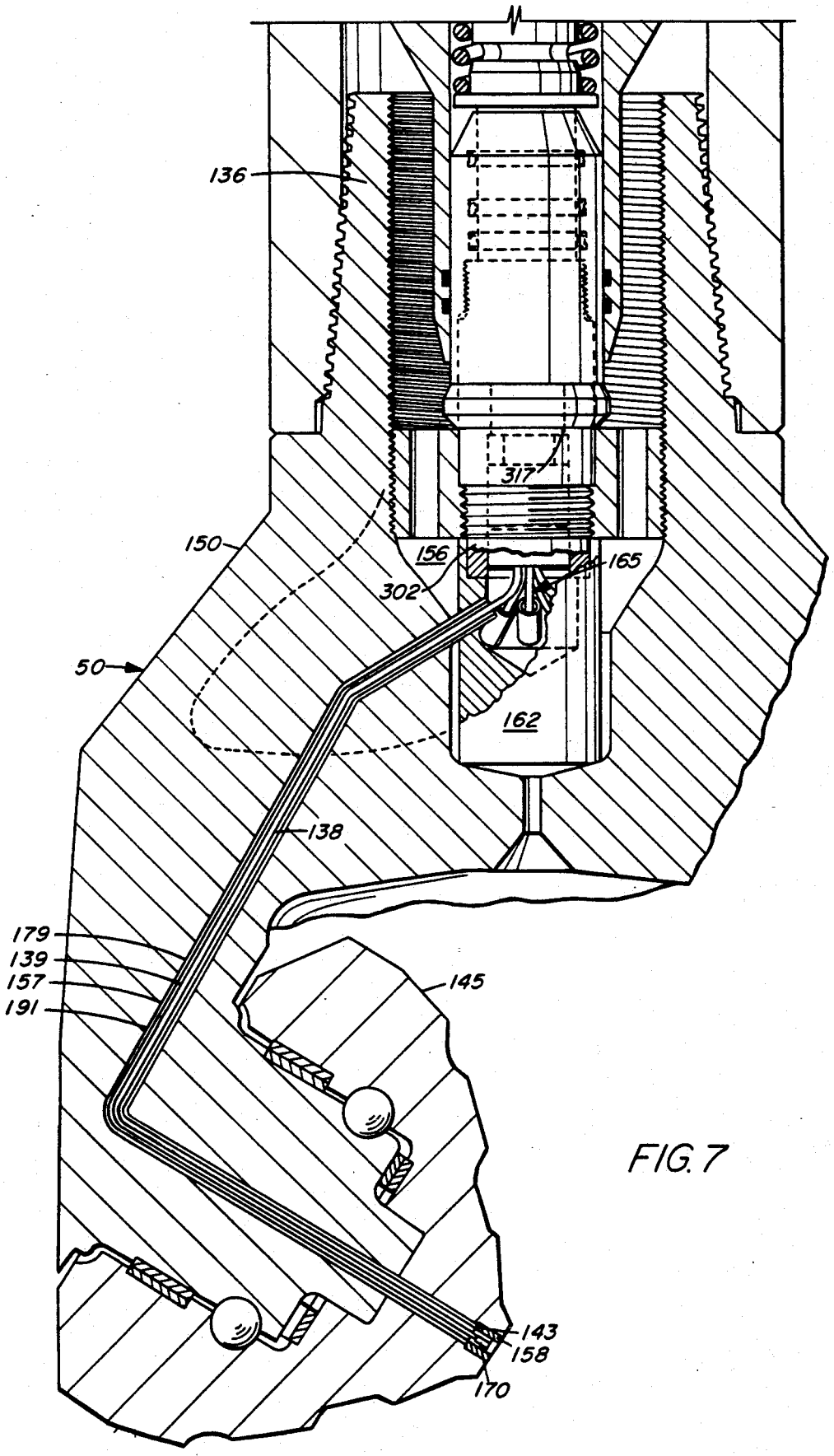
FIG. 7 is a fragmentary, vertical sectional view of a drill bit for use in the short hop system of FIG. 3.

Referring now to FIGS. 3 and 7, the drill bit 50 may comprise any of a number of conventional bits, including a roller cone (or rock) bit or a diamond type bit. For purposes of this discussion, a rock bit will be discussed. One skilled in the art will realize that the teachings herein are also applicable to other types of drill bits. Regardless of the type of bit used, the bit preferably includes a body 150 and a bit face 145 which serves as the drilling or cutting mechanism. As is well known in the art, the bit face 145 may vary substantially depending upon the type of bit used and the hardness of the formation.

Referring now to FIGS. 7 and 9, the drill bit 50 preferably includes a pin connection 136 at its upper end that connects to the sensor sub 200. The bit 50 preferably includes a bore 156 at its upper end extending a short distance into the body 150 of the bit 50.

According to the preferred embodiment depicted in FIG. 7, the drill bit 50 includes a plurality of temperature sensors 170 for monitoring the operation of the bit 50, an electrical contact block 302, and an electrical harness 165 housed in manifold 162 connecting the sensors 170 to the contact block 302.

The temperature sensors 170 preferably comprise six thermistors which are capable of measuring temperatures between 100° F. and 600° F., with an absolute accuracy of ±15° F. According to the preferred embodiment, samples are taken continuously over a ten second interval and the averages of the samples taken during the interval are computed.

The temperature sensors 170 are strategically located in the drill bit 50, preferably close to the bit face 145. All of the temperature sensors 170 and associated electrical leads 138, 139 are housed within small diameter insulated tubes 191 which are appropriately sealed and capable of supporting the external mud pressure and resisting corrosion. The tubes 191 reside in bores 179 extending through the body 150 of bit 50. In the preferred embodiment, the insulated tubes 191 are housed within a steel tube 157. Two electrical leads 138, 139 preferably connect to each sensor 170 to provide a signal line and a return line. The ends of leads 138, 139 extend from tubes 191 and are high temperature soldered to the thermistors 170. Both the thermistors 170 and the ends of the leads 138, 139 are potted in an insulating epoxy 143. A plug 158 is used to seal off the bore 179.

Alternatively, the sensors and leads may be run in an environment of nonconductive grease which is compensated to the pressure of the mud which would otherwise feed such cavities, or protected by a hybrid combination of these two methods utilizing seals and pressure feed-throughs where required.

The electrical leads 138, 139 from the sensors 170 extend to an electrical harness 165 that is located in manifold 162. The manifold 162 is mounted on the centerline of the bore 156 and preferably includes a plurality of apertures for receiving the electrical leads 138, 139 from each of the thermistors 170. The leads 138, 139 from each sensor are physically tied together in the harness 165 and connect to a contact block 302 and feed-through pressure bulkhead 317 which preferably includes at least seven pins or connectors. If only seven connectors are provided in the feed-through 317, then six of the connectors are used for the six signal lines to the temperature sensors 170, and one connector is used as the return line or ground. Thus, if only seven lines are provided, in accordance with the preferred embodiment, then a common ground exists in the harness 165 for grounding the return from each thermistor 170. The manifold 162 preferably is capable of maintaining the environmental pressure externally. The mounting structure at the lower end of the manifold 162 preferably is arranged such that it can be adapted to a drill bit 50 requiring a center jet.

The bottom end of the feed-through 317 connects electrically to the contact block 302, while the upper end connects to conductor 329 (FIG. 9), which in turn connects to the female half of a BEBRO connector 285.

The present invention can be used with all available sizes of rock bits, diamond bits or artificial diamond bits. In smaller drill bits where space is more limited, it may be necessary to position the sensors 170 in the sensor sub 200. In addition to using temperature sensors in the drill bit 50, wear sensors and other sensors may also be used.

The length from the pin shoulder to the face of the bit preferably is less than 13 inches. Some bits which are longer, such as the diamond bits, preferably are modified to include a new upper shank (with a pin connection to match the extended sub or driveshaft), or alternatively are modified to include a special short upper section shank and use a special bit breaker, which uses the gage blades of the bit to make it up.

E. Pulser Collar

Referring again to FIGS. 3, 4, and 5, the pulser collar 35 may be connected to the motor assembly by a crossover sub, a bent sub or a float sub, according to conventional techniques. Any conventional pulser collar may be used in the present invention. An example of such a pulser collar is found in U.S. Pat. Nos. 4,401,134 and 4,515,225, the teachings of which are incorporated herein by reference as if fully set forth herein. Alternatively, other telemetry systems may be used to relay the data received from bit/motor module to the surface. In addition, although the pulser collar 36 is shown in FIGS. 3, 4, and 5 as being below the control sub 45, it should be understood that the pulser collar may be above the control sub. For example, the pulser collar may be on top of the drill collar 85, shown in FIG. 5, or in another location above control sub 45, or host module 10.

F. System Operation

Communication between the sensor module 125 and the control module is effected by electromagnetic (EM) propagation through the surrounding conductive earth. Each module contains both transmitting and receiving circuitry, permitting two-way communication. In operation, the transmitting module generates a modulated carrier, preferably in the frequency range of 100 to 10,000 Hz. This signal voltage is impressed across an insulated axial gap in the outer diameter of the tool, represented by the antennas, either by transformer coupling or by direct drive across a fully-insulated gap in the assembly.

The surface-guided EM wave excited by the antenna propagates through the surrounding conductive earth, accompanied by a current in the metal drillstring. As the EM wave propagates along the string, it is attenuated by spreading and dissipation in the conductive earth according to generally understood principles as described, for instance, by Wait and Hill (1979). The well-known skin effect results from the dissipative attenuation, which increases rapidly with increasing frequency and conductivity. Therefore, as formation conductivity increases (resistivity decreases) the maximum frequency with acceptable attenuation will decrease.

At the same time, increasing conductivity reduces the load resistance across the gaps, permitting higher current to be injected into the formation for a given transmitter power, or reciprocally higher current available to the receiver. In addition, the reduced load resistance lowers the cutoff frequency due to the inductance of a transformer-coupled gap, permitting efficient transmitter operation at lower frequencies. Conversely, with higher resistivity the minimum usable frequency increases, but the reduced attenuation permits operation at higher frequencies.

Since the subject invention is intended to operate with resistivities ranging over several orders of magnitude, which could occur in a single well, it is clearly advantageous and possibly necessary to provide for operation over a wide range of frequencies. It must also be self-adaptive in selecting the proper operating frequency from time to time as formation resistivity changes.

The EM sensor has been designed to minimize the current drain on the sensor battery pack 55. While the tool is being run to bottom, the EM sensor module is in a low power "sleep" mode. Every few minutes, an internal clock in the sensor microprocessor 250, turns on the processor 250 and its associated circuitry for a few seconds, long enough to detect a predetermined sounding signal from the control module. If no such signal is detected by the EM sensor circuitry, the microprocessor and associated circuitry go back into the "sleep" mode until the next power-up period.

When communication is desired by the control module, based upon some condition such as a predetermined downhole pressure, mud flow, rotation, etc., the command module will initiate periodic transmission of sounding signals to command response from the sensor module. In the preferred embodiment, these signals consist of transmitted pulses of a few seconds' duration, alternating with receiving intervals of a similar duration to listen for a response from the sensor module.

Each transmitted pulse concentrates energy at all of the candidate frequencies (preferably from 100 to 10,000 Hz), preferably by a sequence of frequency steps. Other means of transmitting signals at the various frequencies may be used by one skilled in the art, including a continuous frequency sweep, without departing from the principles of the present invention.

Each transmit/receive cycle of the control module occurs within the period of time that the EM sensor module is receiving, thus guaranteeing control transmission during sensor reception.

The sensor module, upon detecting a sounding signal, determines which frequency has the best signal-to-noise ratio, and responds by transmitting a signal to the control module at that frequency. This transmission continues for a duration of at least a full cycle of control module transmission, to guarantee that a signal is sent from the sensor module while the control module is listening.

Once two-way communication is established, subsequent transmissions are completely controlled at the most advantageous frequency. If communication is lost, or if conditions change downhole, both modules revert to a sounding mode.

The sensor module 125 preferably monitors all six thermistors in the drill bit and all sensors located in the sensor sub 200, and transmits readings respecting each sensor to the control module, which preferably relays some or all of these signals to the surface via the host module and mud pulser at a maximum rate of once every five minutes. If it becomes a requirement that data be taken at a significantly higher rate than can be transmitted by mud pulse, data may be stored in memory downhole, or the data may be sorted downhole and/or transmitted to the surface at a rate commensurate with the mud pulse capabilities, or the capabilities of whatever relay telemetry system is used. If sensors are turned on and off (for conservation of batteries), and if a "turn-on" transient settling period is required, sufficient time is provided such that there is no significant biasing of the sample averages due to these transients.

The placement of the sensor module below the motor makes it possible to obtain data regarding a number of parameters of interest and practical application. These parameters include drilling environmental shock and vibration, borehole inclination angle very near bottom, and bit and motor operating temperatures and wear.

The sensor module takes data, performs any required averaging and formatting of the data, and transmits this data around the motor (and perhaps the mud pulse transmitter), a distance of approximately 50 feet, via an electromagnetic (EM) link, to the EM control module located near other MWD sensors, according to the technique described in Section II, A, 7, "Operation of EM Sensor." This control module, in turn, performs further required reduction, local storage, and formatting of data for presentation to the downhole master or host MWD module, which also controls all other MWD sensors downhole. The host module formats or encodes all data transmitted via mud pulse to the surface.

The EM data link operates at a data rate up to approximately 1K baud (1000 bits per second), while the mud pulse data link is approximately 1 bit per second.

During operation, when the EM sensor module 125 is controlled by the EM control module, all sensors (including those in the bit) are powered. The EM sensor module 125 acquires, processes, and transmits data via the EM link. Under this condition the anticipated battery power draw from the battery pack 55 will be approximately 2 watts. Seventy-five percent of this amount is required to power the three accelerometer axes (inclinometer).

The power duty cycle for the EM sensor preferably comprises a maximum of one data acquisition sequence, consisting of a 5 second warm-up period and a 1 second sampling period, for every five minutes of system operation. This equates to a maximum power duty cycle of only 2%, with the average power requirement of the inclinometer being only 30 mW (maximum). Under these assumptions, the total power requirement for the entire system is therefore 530 mW. This correlates to 72 mA current draw at an effective battery pack voltage of 7.4 volts.

In the preferred embodiment, the batteries comprise Electrochem Series RMM 150, 3B1570 DD size batteries or equivalent. With these batteries, a conservative capacity estimate is 20 ampere hours.

When the battery pack is connected to the EM sensor module, but it is in the "standby" mode, whereby it is awaiting command from the EM control module, the system is considered powered but "asleep". The power required for this mode of operation is only that necessary to keep the logic associated with this standby function alive. The system normally reverts to this mode of operation upon connection to the battery pack. Under this condition, the anticipated battery power requirement will be approximately 250 mW. This correlates to a current draw of approximately 34 mA at the effective battery pack voltage of 7.4 volts. This current draw equates to a battery life estimate (using 20 ampere hours) of 588 hours. The preferred operating temperature range for the batteries is between 0° C. to 150° C.

While a preferred embodiment of the invention has been disclosed, various modifications can be made to the preferred embodiment without departing from the principles of the present invention.

We claim:

1. A measurement while drilling system, comprising:

a drill string including a bottom-hole assembly, terminating in a drill bit;

a motor means in said bottom-hole assembly, positioned uphole from said drill bit, for producing relative motion at one end of the motor with respect to the other end of the motor;

means, as part of said bottom-hole assembly, for sensing parameters downhole, wherein said sensing means is positioned downhole from said motor means and includes a communication device, including a transmitter and a receiver;

a control module as part of said bottom-hole assembly, including a transmission means, positioned uphole from said motor means;

wherein said control module transmits a command signal to said sensing means, and said sensing means transmits a data signal representative of a sensed parameter to said control module.

2. A measurement while drilling system as set forth in claim 1, wherein said control module transmits a command signal at stepped frequencies to said sensing means, and said sensing means includes means for determining the frequency with the best signal-to-noise ratio to transmit said data signal to said control module.

3. A short-hop electromagnetic communication based data acquisition system for transmission of measured operating, environmental and directional parameters in a well, comprising:

(a) a drill string including a bottom-hole assembly, terminating in a drill bit;

(b) motor means for operating said drill bit;

(c) means for connecting said motor means to said drill bit;

(d) means for sensing any one of said parameters and generating an output signal indicative thereof, said sensing means being housed in said connecting means;

(e) transmission means for receiving the output signal from said sensing means and for generating an electromagnetic data signal, said transmission means being housed in said connecting means; and (f) data communication control means forming part of said bottom-hole assembly and positioned uphole from said motor means, said data communication control means including a receiver means for receiving the electromagnetic data signal.

4. A system as in claim 3, wherein said connecting means includes a pressure container, and said sensing means is housed in the pressure container.

5. A system as in claim 4, further comprising a battery pack, housed in the pressure container, for providing power to said sensing means and said transmission means.

6. A system as in claim 4, wherein said sensing means resides in a sensor module within said pressure container.

7. A system as in claim 6, wherein said pressure container includes a cap retainer in electrical contact with the sensor module;

said transmission means includes an antenna; and said cap retainer and said pressure container form part of a current path between the antenna and the sensor module.

8. A system as in claim 7, wherein said antenna comprises an annular antenna mounted on the exterior of the connecting means.

9. A system as in claim 8, further comprising an anchor pin for supporting and aligning the pressure container within said connecting means and for forming part of the current path between the antenna and the sensor module.

10. A system as in claim 9, wherein the annular antenna is secured to the connecting means by an insulating epoxy.

11. A system as in claim 10, wherein a protective shield is mounted over said antenna with an insulating material in between said antenna and said shield, and said shield is conductive and electrically connected to said connecting means to define a part of the current path from the antenna to the sensor module, so that said current path includes the shield, the connecting means, the anchor pin, the pressure container, and the cap retainer.

12. A system as in claim 6, further comprising an insulator inside the pressure container which abuts said sensor module.

13. A system as in claim 12, further comprising a pressure feed-through, through said pressure container and said connecting means, with an electrical contact therethrough for connecting to an antenna on the exterior of the connecting means.

14. A system as in claim 13, wherein the insulator includes an electrical conductor that connects to said sensor module and said electrical contact in the pressure feed-through.

15. A system as in claim 3, wherein said data communication control means includes telemetry means for communicating information reflecting the electromagnetic data signal to the surface.

16. A system as in claim 3, wherein said drill bit includes sensors therein for monitoring operational parameters of said drill bit and for providing a signal indicative thereof to said sensing means.

17. A system as in claim 16, wherein said sensing means connects electrically to said drill bit for receiving the signals from the sensors in said drill bit.

18. A system as in claim 3, wherein said connecting means comprises a sub, and said sensing means and said transmission means are positioned in the sub.

19. A system as in claim 3, wherein said connecting means comprises an extended driveshaft, and said sensing means and said transmission means are positioned in the extended driveshaft.

20. A system as in claim 3, further comprising means connected to said sensing means for processing the output signals received from said sensing means.

21. A system as in claim 20, wherein said data communication control means also includes a control transmitter and said data communication control means generates command signals which are transmitted by said control transmitter, and said transmission means includes a sensor receiver which receives the command signals and relays the command signals to said processing means.

22. A system as in claim 20, wherein said processing means includes a memory for storing said output signals.

23. A system as in claim 15, wherein said telemetry means comprises a mud pulser.

24. A system as in claim 23, wherein said data communication control means includes a processor unit for processing said electromagnetic data signal.

25. A system as in claim 24, wherein said processing means includes a memory for storing the electromagnetic data signal.

26. A downhole telemetry system for transmitting data signals between two points downhole in a well, comprising:

a drill bit;

a pulser collar located above said drill bit for transmitting mud pulses to an acoustic receiver located near the surface of the well;

a control module located above said pulser collar and connected electrically to said pulser collar and disposed at a subsurface location downhole of and remote from the acoustic receiver;

tubing means positioned between said pulser collar and said drill bit;

transmitter means positioned in said tubing means for transmitting the data signals; and receiver means positioned in said control module for receiving the data signals transmitted from said transmitter means.

27. A system as set forth in claim 26, wherein said receiver means comprises a first transceiver for sending command signals to said transmitter means, and said transmitter means comprises a second transceiver for receiving the command signals from said receiver means.

28. A system as set forth in claim 26, wherein said tubing means includes a motor means for operating said drill bit.

29. A system as set forth in claim 28, wherein said motor means includes a driveshaft, which is connected to said drill bit, and said transmitter means is housed in said drive shaft.

30. A system as set forth in claim 28, wherein said tubing means also includes a sub connected to said motor means and to said drill bit, and said transmitter means is housed in said sub.

31. A system as set forth in claim 30, wherein said drill bit is spring-loaded to said sub.

32. A system as set forth in claim 28, wherein said motor means comprises a positive displacement motor.

33. A system as set forth in claim 32, wherein said positive displacement motor includes a bent housing.

34. A system as in claim 31, wherein said sub includes a pressure container, and said transmitter means is partially housed in the pressure container.

35. A system as in claim 34, further comprising a battery pack, housed in the pressure container, for providing power to said transmitter means.

36. A system as in claim 35, wherein said transmitter means includes an annular antenna mounted on the exterior of the sub.

37. A system as in claim 36, wherein the pressure container forms part of a return current path between said annular antenna and said transmitter means.

38. A system as in claim 31, wherein said drill bit includes sensors therein for monitoring operational parameters of said drill bit and for providing a signal indicative thereof to said transmitter means.

39. A system as set forth in claim 28, wherein said transmitter means is located in said motor means.

40. A system as set forth in claim 26, wherein said data signal is transmitted by an electromagnetic wave.

41. A system as set forth in claim 40, wherein said transmitter means includes an annular antenna.

42. A system as set forth in claim 41, wherein said receiver means includes an annular antenna.

43. A system as set forth in claim 26, wherein said data signals reflect operating parameters of the drill bit.

44. A system as set forth in claim 28, wherein said data signals reflect operating parameters of the motor means.

45. A system as set forth in claim 26, wherein said data signals reflect environmental conditions in the vicinity of said drill bit.

46. A system as set forth in claim 28, wherein said data signals reflect environmental conditions in the vicinity of said motor means.

47. A system as set forth in claim 26, wherein said data signals reflect directional information relating to said drill bit.

48. A system as set forth in claim 28, wherein said data signals reflect directional information relating to said motor means.

49. A system for transmitting signals a relatively short distance downhole, comprising:

a downhole component disposed at a subsurface location;

sensor means disposed below said downhole component for monitoring at least one of the operational, environmental, and directional parameters, downhole and providing electrical signals indicative thereof;

a first subsurface transceiver means, electrically connected to said sensor means, positioned on the downhole side of said component for obtaining said electrical signals from said sensor means and transmitting electromagnetic data signals correlative to said electrical signals; and second subsurface transceiver means positioned on the uphole side of said component for receiving said electromagnetic data signals from said first transceiver means.

50. A short-hop electromagnetic communication based data acquisition system for transmission of measured operating, environmental and directional parameters in a well, comprising:

(a) motor means with an extended driveshaft;

(b) means for sensing one of said parameters and generating an output signal indicative thereof, said sensing at least means being housed in said extended driveshaft;

(c) transmission means for receiving the output signal from said sensing means and for generating an electromagnetic data signal, said transmission means being housed in said extended driveshaft; and (d) data communication control means positioned at a subsurface location uphole from said motor means, said data communication means including receiver means for receiving the electromagnetic data signal.

51. A system as in claim 50, wherein said data communication means includes means for transmitting command signals and said transmission means includes means for receiving said command signals.

52. A system as in claim 50, further comprising:

a battery connected to said transmission means and said sensing means for supplying power, said battery being housed in said extended driveshaft.

53. A system as in claim 52, wherein said extended driveshaft includes a pressure container in which the battery is located.

54. A system as in claim 53, wherein said sensing means is located in a sensor module within said pressure container.

55. A system as in claim 54, wherein said pressure container includes orientation guide pins which are received in said sensor module.

56. A system as in claim 54, wherein the sensing means is constructed of aluminum and coated with fiberglass.

57. A short-hop electromagnetic communication based data acquisition system for transmission of measured operating, environmental and directional parameters near the motor a short distance in a well, comprising:

(a) means for sensing at least one of said parameters and generating an output signal indicative thereof, said sensing means being housed in a sub below said motor;

(b) transmission means for receiving the output signal from said sensing means and for generating an electromagnetic data signal, said transmission means also being housed in said sub;

(c) data communication control means positioned uphole from said motor, said data communication means including (1) receiver means positioned a short distance from said transmission means for receiving the electromagnetic data signal, and (2) a telemetry means for communicating information reflecting the electromagnetic data signal to the surface;

(d) a battery connected to said transmission means and said sensing means for supplying power, said battery being housed in said sub.

58. A method for communicating operating, environmental and directional parameters from near a drill bit, around a motor, to the surface of a well, including the steps of:

(a) sensing at least one of said parameters;

(b) transmitting an electromagnetic signal indicative of said sensed parameter a relatively short distance from below the motor;

(c) receiving the electromagnetic signal at a point above the motor;

(d) converting at least a portion of the electromagnetic signal to a mud pulse signal; and (e) transmitting said mud pulse signal to the surface.

59. A method for communicating parameters measured near a drill bit to a point above a motor, including the steps of:

(a) transmitting a command signal from the point above the motor;

(b) receiving the command signal at a point in a bottom-hole assembly below the motor;

(c) deciphering the command signal to determine the parameter desired;

(d) sensing the desired parameter;

(e) transmitting a signal indicative of said sensed parameter a relatively short distance from below the motor;

(f) receiving the signal at a subsurface point above the motor and within said relatively short distance;

(g) analyzing the signal to recover information indicative of the desired parameter.

60. A method as in claim 59, wherein the command signal of steps (a)-(c) is an electromagnetic signal.

61. A method as in claim 60, wherein the signal of steps (e)-(g) is an electromagnetic signal.

62. A method for communicating parameters measure near a drill bit in a well to a point above a motor, including the steps of:

(a) transmitting a command signal from a first downhole point in a downhole assembly above the motor at a variety of frequencies, said first downhole point being remote from the surface of the well;

(b) receiving the command signal at a second downhole point below the motor;

(c) determining the frequency which delivers the best signal-to-noise ratio for the transmission from said first downhole point to said second downhole point;

(d) transmitting a signal from said second downhole point to said first downhole point indicative of the desired parameter, at the frequency with the best signal-to-noise ratio.

63. An apparatus measuring parameters near the drill bit, comprising:

a bottom-hole assembly, including a drill bit;

a downhole motor, in the bottom-hole assembly, positioned above the drill bit;

a sensor module, in the bottom-hole assembly, positioned between the drill bit and the motor, said sensor module including a first transceiver means and a processing means;

a control module, in the bottom-hole assembly, positioned above the motor, said control module including a second transceiver means;

wherein said second transceiver means emits a sounding signal at a variety of frequencies which are detected by said first transceiver means, and said processing means analyzes the received signals to determine which frequency has the best signal-to-noise ratio.

64. A short-hop electromagnetic communication based data acquisition system for transmission of measured operating, environmental and directional parameters in a well, comprising:

(a) a downhole assembly terminating in a drill bit;

(b) a downhole component;

(c) connecting means for connecting said downhole component to said drill bit;

(d) means for sensing at least one of said parameters and generating an output signal indicative thereof, said sensing means being housed in said connecting means;

(e) transmission means for receiving the output signal from said sensing means and for generating an electromagnetic data signal, said transmission means being housed in said connecting means; and (f) data communication control means positioned in said downhole assembly uphole from said downhole component, said data communication control means including a receiver means for receiving the electromagnetic data signal.

65. A system as in claim 3, wherein said motor means produces relative motion at one end of the motor with respect to the other end of the motor to operate said drill bit.

66. A system as in claim 65, wherein said sensing means includes formational sensors located in said connecting means.

67. A system as in claim 65, where said sensing means includes operational sensors located in said connecting means.

68. A system as in claim 65, wherein said sensing means includes directional sensors located in said connecting means.

69. A system as in claim 19, wherein said sensing means includes formational sensors located in said extended driveshaft.

70. A system as in claim 19, wherein said sensing means includes directional sensors located in said extended driveshaft.

71. A system as in claim 19, wherein said transmission means includes an antenna mounted on the exterior of said extended driveshaft.

72. A system as in claim 64, wherein said sensing means includes an environmental sensor located in said connecting means.

73. A system as in claim 64, wherein said sensing means includes an operational sensor located in said connecting means.

74. A system as in claim 64, wherein said sensing means includes a directional sensor located in said connecting means.

75. A system as in claim 64, wherein said connecting means comprises a driveshaft of a motor and said transmission means includes an antenna that mounts on the exterior of the driveshaft.

76. A system as in claim 64, further comprising a host module electrically connected to said data communication control means.

77. A system as in claim 76, wherein said data communication control means processes the data signal received from said sensing means to obtain an electrical signal representative of the sensed parameter, and said control means transmits the representative electrical signal to said host module.

78. A system as in claim 77, wherein said host module, in addition to receiving the representative electrical signal from said control module, also receives electrical data signals from other downhole sensor modules.

79. A system as in claim 78, wherein said host module processes the electrical data signals to develop a coded signal that is transmitted to a surface receiver.

80. A system as in claim 78, wherein said host module stores a portion of the electrical data signals.

* * * * *

US005160925C1

(12) REEXAMINATION CERTIFICATE (4283rd)

United States Patent

Dailey et al.

(10) Number: US 5,160,925 C1

(45) Certificate Issued: Mar. 6, 2001

(54) SHORT HOP COMMUNICATION LINK FOR DOWNHOLE MWD SYSTEM

(75) Inventors: Patrick E. Dailey, Lomita, CA (US); Charles D. Barron, Kingwood, TX (US); Louis H. Rorden, Los Altos, CA (US)

(73) Assignee: Halliburton Company, Duncan, OK (US)

Reexamination Request:
No. 90/005,082, Aug. 24, 1998

Reexamination Certificate for:

| | |
|---|---|
| Patent No.: | **5,160,925** |
| Issued: | **Nov. 3, 1992** |
| Appl. No.: | **07/686,772** |
| Filed: | **Apr. 17, 1991** |

(51) Int. Cl.[7] ..... G01V 3/00

(52) U.S. Cl. ..... 340/853.3; 340/854.6; 340/853.1; 367/76; 367/81; 367/83; 175/40; 73/152.46

(58) Field of Search ..... 340/853.3, 854.6, 340/853.1; 367/76, 81, 83; 175/40; 73/151

(56) References Cited

U.S. PATENT DOCUMENTS 5,034,929 * 7/1991 Cobern et al. ..... 367/83
5,113,379 * 5/1992 Scherbatskoy ..... 367/83

OTHER PUBLICATIONS

Video and Written Transcript of "'MWD' An Idea Whose time has Come", copyright 1990.

* cited by examiner

*Primary Examiner*—J. Woodrow Eldred

(57) ABSTRACT

The short hop communication link includes a sensor module positioned downhole from a motor in a well. The module includes sensors that monitor operational, directional and environmental parameters downhole and provide an electrical data signal indicative thereof. Sensors may also be positioned in the drill bit for obtaining parameters related to the bit, and communicating data signals reflecting the sensed parameters to the sensor module. The sensor module includes a transceiver, with an annular antenna, for transmitting electromagnetic sensor data signals to a point above the motor. A control module, which also includes a transceiver with an annular antenna, is located above the motor, and receives the electromagnetic signals from the sensor module reflecting the sensed parameters. In addition, the control module is capable of transmitting command signals to the sensor module requesting data regarding desired parameters. The command module connects to a host module which orchestrates all measurement-while-drilling components downhole. The host module connects to a mud pulser for transmitting desired data to the surface for real-time processing. The sensor module is strategically placed within a removable, interchangeable sub below the motor, or alternatively, within an extended driveshaft of the motor, while the sensor antenna is located on an exterior shoulder of the sub or driveshaft. The sensor module and an associated battery pack reside within a pressure container which forms part of a current return path from the sensor antenna to the circuitry within the sensor module.

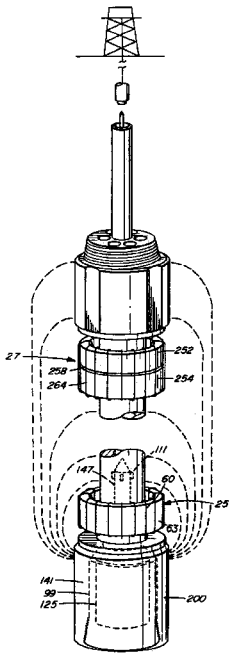

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–80 is confirmed.

* * * * *